US012351923B2

(12) United States Patent
Nagatsuka et al.

(10) Patent No.: US 12,351,923 B2
(45) Date of Patent: Jul. 8, 2025

(54) ORGANIC HYDRIDE PRODUCING SYSTEM, CONTROL DEVICE FOR ORGANIC HYDRIDE PRODUCING SYSTEM, AND CONTROL METHOD FOR ORGANIC HYDRIDE PRODUCING SYSTEM

(71) Applicant: ENEOS CORPORATION, Tokyo (JP)

(72) Inventors: Tomomi Nagatsuka, Tokyo (JP); Shuro Cho, Tokyo (JP); Koji Matsuoka, Tokyo (JP); Akira Goto, Tokyo (JP)

(73) Assignee: ENEOS Corporation, Tokyo (JP)

( * ) Notice: Subject to any disclaimer, the term of this patent is extended or adjusted under 35 U.S.C. 154(b) by 0 days.

(21) Appl. No.: 18/254,295

(22) PCT Filed: Dec. 2, 2021

(86) PCT No.: PCT/JP2021/044349
§ 371 (c)(1),
(2) Date: May 24, 2023

(87) PCT Pub. No.: WO2022/118934
PCT Pub. Date: Jun. 9, 2022

(65) Prior Publication Data

US 2024/0011175 A1 Jan. 11, 2024

(30) Foreign Application Priority Data

Dec. 4, 2020 (JP) ..... 2020-201822

(51) Int. Cl.
*C25B 15/029* (2021.01)
*C25B 3/03* (2021.01)
(Continued)

(52) U.S. Cl.
CPC ..... *C25B 15/029* (2021.01); *C25B 3/03* (2021.01); *C25B 3/25* (2021.01); *C25B 15/02* (2013.01); *C25B 15/023* (2021.01); *C25B 15/08* (2013.01)

(58) Field of Classification Search
None
See application file for complete search history.

(56) References Cited

U.S. PATENT DOCUMENTS 11,519,082 B2 12/2022 Mitsushima et al.
2007/0240997 A1 10/2007 Machado et al.
(Continued)

FOREIGN PATENT DOCUMENTS

JP 2007284790 A 11/2007
JP 2018080361 A 5/2018
WO 2012091128 A1 7/2012

OTHER PUBLICATIONS

International Preliminary Report on Patentability mailed on May 30, 2023, by the International Bureau of WIPO for Application No. PCT/JP2021/044349. (10 pages).
(Continued)

*Primary Examiner* — Wojciech Haske
(74) *Attorney, Agent, or Firm* — BUCHANAN, INGERSOLL & ROONEY PC

(57) ABSTRACT

An organic hydride producing system includes: an electrolytic bath having a cathode chamber; a catholyte supply device capable of supplying any catholyte selected from a plurality of the catholytes having different concentrations of substances to be hydrogenated to the cathode chamber; and a control device that controls the catholyte supply device so as to supply a catholyte to the cathode chamber, the catholyte having a specific concentration of a substance to be
(Continued)

hydrogenated determined according to a magnitude of a current flowing in the electrolytic bath.

6 Claims, 6 Drawing Sheets

(51) Int. Cl.

| | |
|---|---|
| ***C25B 3/25*** | (2021.01) |
| ***C25B 15/02*** | (2021.01) |
| ***C25B 15/023*** | (2021.01) |
| ***C25B 15/08*** | (2006.01) |

(56) References Cited

U.S. PATENT DOCUMENTS

| | | | | |
|---|---|---|---|---|
| 2013/0313127 | A1 | 11/2013 | Sato et al. | |
| 2016/0017503 | A1* | 1/2016 | Kaczur | C25B 3/25 205/346 |
| 2016/0145751 | A1* | 5/2016 | Sato | C25B 3/25 205/422 |

OTHER PUBLICATIONS

International Search Report (PCT/ISA/210) mailed on Jan. 11, 2022, by the Japan Patent Office as the International Searching Authority for International Application No. PCT/JP2021/044349. (5 pages).

Extended European Search Report issued on Apr. 1, 2025, in corresponding European Patent Application No. 21900684.8. (33 pages).

* cited by examiner

ORGANIC HYDRIDE PRODUCING SYSTEM, CONTROL DEVICE FOR ORGANIC HYDRIDE PRODUCING SYSTEM, AND CONTROL METHOD FOR ORGANIC HYDRIDE PRODUCING SYSTEM

CROSS-REFERENCE TO RELATED APPLICATIONS

This application is based upon and claims the benefit of priority from the prior Japanese Patent Application No. 2020-201822, filed on Dec. 4, 2020, and International Patent Application No. PCT/JP2021/044349, filed on Dec. 2, 2021, the entire content of each of which is incorporated herein by reference.

BACKGROUND

Field of the Invention

The present invention relates to an organic hydride producing system, a control device for an organic hydride producing system, and a control method for an organic hydride producing system.

Description of the Related Art

In recent years, in order to suppress the carbon dioxide emission amount in the energy generation process, it is expected to use renewable energy obtained by solar power, wind power, hydraulic power, geothermal power generation, and the like. As an example, a system for generating hydrogen by performing water electrolysis using power derived from renewable energy has been devised. In addition, an organic hydride system has attracted attention as an energy carrier for large-scale transportation and storage of hydrogen derived from renewable energy.

Regarding a technique for producing an organic hydride, there has been conventionally known an organic hydride producing system including an electrolytic bath including an oxidation electrode for generating protons from water and a reduction electrode for hydrogenating an organic compound (substance to be hydrogenated) having an unsaturated bond (see, for example, Patent Literature 1). In this organic hydride producing system, a current flows between the oxidation electrode and the reduction electrode while water is supplied to the oxidation electrode, and a substance to be hydrogenated is supplied to the reduction electrode, so that hydrogen is added to the substance to be hydrogenated to obtain an organic hydride.

Patent Literature 1: WO 2012/091128 A

As a result of intensive studies on the above-described technique for producing an organic hydride, the present inventors have recognized that in the conventional technique, the Faraday efficiency may decrease when the production speed of the organic hydride is increased.

SUMMARY OF THE INVENTION

The present invention has been made in view of such circumstances, and one object of the present invention is to provide a technique for improving a production speed of an organic hydride while suppressing a decrease in Faraday efficiency of an organic hydride producing system.

One aspect of the present invention is an organic hydride producing system. This organic hydride producing system includes: an electrolytic bath having a cathode chamber for accommodating a cathode electrode for hydrogenating a substance to be hydrogenated in a catholyte with a proton to generate an organic hydride; a catholyte supply device capable of supplying any catholyte selected from a plurality of the catholytes having different concentrations of substances to be hydrogenated to the cathode chamber; and a control device structured to control the catholyte supply device so as to supply a catholyte to the cathode chamber, the catholyte having a specific concentration of a substance to be hydrogenated determined according to a magnitude of a current flowing in the electrolytic bath.

Another aspect of the present invention is a control device of an organic hydride producing system including an electrolytic bath and a catholyte supply device. The electrolytic bath has a cathode chamber for accommodating a cathode electrode for hydrogenating a substance to be hydrogenated in a catholyte with a proton to generate an organic hydride. The catholyte supply device is capable of supplying any catholyte selected from a plurality of the catholytes having different concentrations of substances to be hydrogenated to the cathode chamber. The control device controls the catholyte supply device so as to supply the catholyte to the cathode chamber, the catholyte having a specific concentration of a substance to be hydrogenated determined according to a magnitude of a current flowing in the electrolytic bath.

Another aspect of the present invention is a method for controlling an organic hydride producing system including an electrolytic bath having a cathode chamber for accommodating a cathode electrode for hydrogenating a substance to be hydrogenated in a catholyte with a proton to generate an organic hydride. This control method includes supplying the catholyte to the cathode chamber, the catholyte having a specific concentration of a substance to be hydrogenated determined according to a magnitude of a current flowing in the electrolytic bath.

Any combinations of the above components and conversion of the expressions of the present disclosure among methods, devices, systems, and the like are also effective as aspects of the present disclosure.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
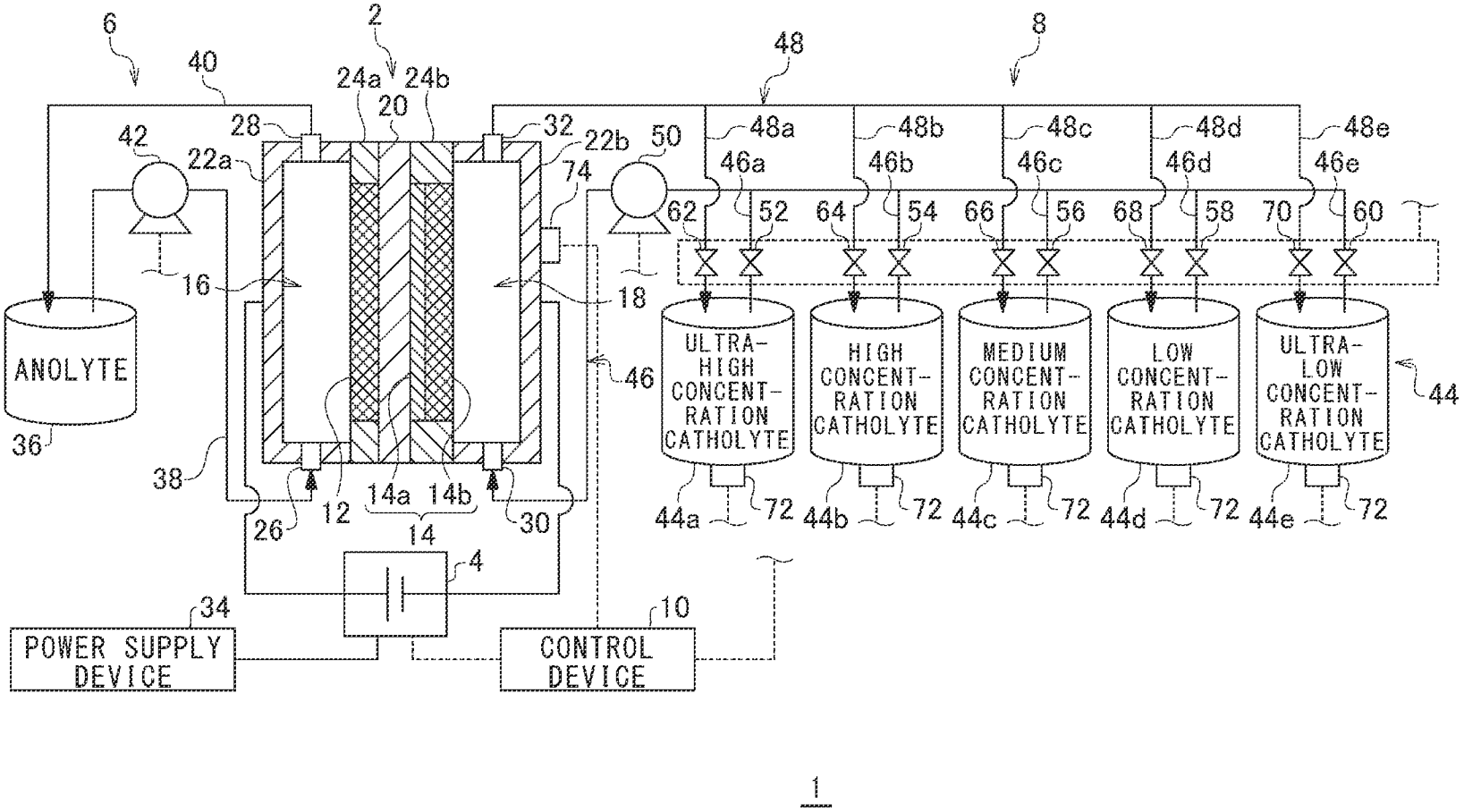
FIG. 1 is a schematic diagram of an organic hydride producing system according to a first embodiment.

Hereinafter, the present invention will be described based on preferred embodiments with reference to the drawings.

The embodiments are illustrative rather than limiting the invention, and not all features described in the embodiments and combinations thereof are necessarily essential to the invention. The same or equivalent components, members, and processes shown in the drawings are denoted by the same reference numerals, and redundant description will be omitted as appropriate.

In addition, the scale and shape of each part shown in each drawing are set for convenience in order to facilitate the description, and are not to be limitedly interpreted unless otherwise specified. Furthermore, when the terms "first", "second", and the like are used in the present specification or claims, the terms do not represent any order or importance, but are used to distinguish one configuration from another configuration. In addition, in each drawing, some of members that are not important for describing the embodiments are omitted.

First Embodiment

FIG. 1 is a schematic diagram of an organic hydride producing system 1 according to a first embodiment. The organic hydride producing system 1 mainly includes an electrolytic bath 2, a power supply 4, an anolyte supply device 6, a catholyte supply device 8, and a control device 10.

The electrolytic bath 2 generates an organic hydride by hydrogenating substance to be hydrogenated, which is a dehydrogenated product of an organic hydride, by an electrochemical reduction reaction. The electrolytic bath 2 includes an anode electrode 12, a cathode electrode 14, an anode chamber 16, a cathode chamber 18, and a membrane 20.

The anode electrode 12 (anode) oxidizes water in an anolyte to generate protons. The anode electrode 12 has, as an anode catalyst, a metal such as iridium (Ir), ruthenium (Ru), or platinum (Pt), or a metal oxide thereof. The anode catalyst may be dispersively supported or coated on a base material having electron conductivity. The base material is made of a material containing a metal as a main component, such as titanium (Ti) or stainless steel (SUS). Examples of the form of the base material include a sheet of a woven fabric or a nonwoven fabric, a mesh, a porous sintered body, a foamed molded body (foam), and an expanded metal. The anode catalyst may also be applied directly to the membrane 20.

The cathode electrode 14 (cathode) hydrogenates a substance to be hydrogenated in a catholyte with protons to generate an organic hydride. The cathode electrode 14 of the present embodiment includes a catalyst layer 14*a* and a diffusion layer 14*b*. The catalyst layer 14*a* is disposed closer to the membrane 20 than the diffusion layer 14*b*. The catalyst layer 14*a* of the present embodiment is in contact with the main surface of the membrane 20. The catalyst layer 14*a* contains, for example, platinum or ruthenium as a cathode catalyst for hydrogenating the substance to be hydrogenated. Preferably, the catalyst layer 14*a* contains a porous catalyst support that supports a cathode catalyst. The catalyst support is made of an electron conductive material such as porous carbon, a porous metal, or a porous metal oxide. For example, the catalyst layer 14*a* is formed by directly applying the cathode catalyst to the membrane 20.

The cathode catalyst is coated with an ionomer (cation exchange ionomer). For example, the catalyst support in a state of supporting the cathode catalyst is coated with an ionomer. Examples of the ionomer include perfluorosulfonic acid polymers such as Nafion (registered trademark) and Flemion (registered trademark). It is preferable that the cathode catalyst is partially coated with the ionomer. As a result, three elements (substances to be hydrogenated, protons, and electrons) necessary for an electrochemical reaction in the catalyst layer 14*a* can be efficiently supplied to the reaction field.

The diffusion layer 14*b* uniformly diffuses a substance to be hydrogenated in a liquid state supplied from the outside into the catalyst layer 14*a*. An organic hydride generated in the catalyst layer 14*a* is discharged to the outside of the catalyst layer 14*a* via the diffusion layer 14*b*. The diffusion layer 14*b* of the present embodiment is in contact with a main surface of the catalyst layer 14*a* on a side opposite to the membrane 20. The diffusion layer 14*b* is made of a conductive material such as carbon or metal. The diffusion layer 14*b* is a porous body such as a sintered body of fibers or particles or a foamed molded body. Specific examples of the material constituting the diffusion layer 14*b* include a carbon woven fabric (carbon cloth), a carbon nonwoven fabric, and carbon paper.

The anode electrode 12 is accommodated in the anode chamber 16. The anode chamber 16 is defined by, for example, the membrane 20, an end plate 22*a*, and a spacer 24*a*. The end plate 22*a* is a plate material made of metal such as stainless steel or titanium, for example, and is installed on the anode electrode 12 on the side opposite to the membrane 20. The end plate 22*a* as an example has a groove-shaped flow path on a main surface facing the anode electrode 12 side. The anolyte supplied to the anode chamber 16 is supplied to the anode electrode 12 through the flow path, and is discharged from the anode chamber 16 through the flow path. The spacer 24*a* is a frame-shaped sealing material disposed between the membrane 20 and the end plate 22*a*. A space excluding the anode electrode 12 in the anode chamber 16 constitutes a flow path of the anolyte.

The end plate 22*a* is provided with a first anode opening 26 and a second anode opening 28 that communicate the inside and the outside of the anode chamber 16. The first anode opening 26 is disposed below the second anode opening 28. In the present embodiment, the first anode opening 26 is provided on a bottom surface of the anode chamber 16, and the second anode opening 28 is provided on a top surface of the anode chamber 16. The first anode opening 26 and the second anode opening 28 may or may not overlap when viewed from the vertical direction.

The cathode electrode 14 is accommodated in the cathode chamber 18. The cathode chamber 18 is defined by, for example, the membrane 20, an end plate 22*b*, and a spacer 24*b*. The end plate 22*b* is a plate material made of metal such as stainless steel or titanium, for example, and is installed on the cathode electrode 14 on the side opposite to the membrane 20. The end plate 22*b* as an example has a groove-shaped flow path on a main surface facing the cathode electrode 14 side. The catholyte supplied to the cathode chamber 18 is supplied to the cathode electrode 14 through the flow path, and is discharged from the cathode chamber 18 through the flow path. The spacer 24*b* is a frame-shaped sealing material disposed between the membrane 20 and the end plate 22*b*. A space excluding the cathode electrode 14 in the cathode chamber 18 constitutes a flow path of the catholyte.

The end plate 22*b* is provided with a first cathode opening 30 and a second cathode opening 32 that communicate the inside and the outside of the cathode chamber 18. The first cathode opening 30 is disposed below the second cathode opening 32. In the present embodiment, the first cathode opening 30 is provided on a bottom surface of the cathode chamber 18, and the second cathode opening 32 is provided on a top surface of the cathode chamber 18. The first cathode opening 30 and the second cathode opening 32 may or may not overlap when viewed from the vertical direction.

The anode chamber 16 and the cathode chamber 18 are partitioned by the membrane 20. The membrane 20 is sandwiched between the anode electrode 12 and the cathode electrode 14. The membrane 20 of the present embodiment is composed of a solid polymer electrolyte membrane having proton conductivity, and transfers protons from the anode chamber 16 side to the cathode chamber 18 side. The solid polymer electrolyte membrane is not particularly limited as long as it is a material through which protons conduct, and examples thereof include a fluorine-based ion exchange membrane having a sulfonate group.

The anolyte is supplied to the anode chamber 16 by the anolyte supply device 6. The anolyte contains water for supply to the anode electrode 12. Examples of the anolyte include an aqueous sulfuric acid solution, an aqueous nitric acid solution, an aqueous hydrochloric acid solution, pure water, and ion-exchanged water.

The catholyte is supplied to the cathode chamber 18 by the catholyte supply device 8. The catholyte contains an organic hydride raw material (substance to be hydrogenated) to be supplied to the cathode electrode 14. As an example, the catholyte does not contain an organic hydride before the operation of the organic hydride producing system 1 is started, and the organic hydride generated by electrolysis after the operation is started is mixed in, so that the catholyte becomes a liquid mixture of the substance to be hydrogenated and the organic hydride. The substance to be hydrogenated and the organic hydride are preferably liquid at 20° C. and 1 atm.

The substance to be hydrogenated and the organic hydride used in the present embodiment are not particularly limited as long as they are organic compounds capable of adding/desorbing hydrogen by reversibly causing a hydrogenation reaction/dehydrogenation reaction. For the substance to be hydrogenated and the organic hydride, for example, an acetone-isopropanol type, a benzoquinone-hydroquinone type, an aromatic hydrocarbon type, and the like can be widely used. Among these, an aromatic hydrocarbon type is preferable from the viewpoint of transportability during energy transport or the like.

The aromatic hydrocarbon compound used as the substance to be hydrogenated is a compound containing at least one aromatic ring. Examples of the aromatic hydrocarbon compound include benzene, alkylbenzenes, naphthalene, alkylnaphthalenes, anthracene, and diphenylethane. Alkylbenzenes include a compound in which 1 to 4 hydrogen atoms in the aromatic ring are substituted with a linear alkyl group or a branched alkyl group having 1 to 6 carbon atoms. Examples of such a compound include toluene, xylene, mesitylene, ethylbenzene, and diethylbenzene. Alkylnaphthalenes include a compound in which 1 to 4 hydrogen atoms in the aromatic ring are substituted with a linear alkyl group or a branched alkyl group having 1 to 6 carbon atoms. Examples of such a compound include methylnaphthalene. These compounds may be used alone or in combination.

The substance to be hydrogenated is preferably at least one of toluene and benzene. A nitrogen-containing heterocyclic aromatic compound such as pyridine, pyrimidine, pyrazine, quinoline, isoquinoline, N-alkylpyrrole, N-alkylindole, or N-alkyldibenzopyrrole can also be used as the substance to be hydrogenated. The organic hydride is obtained by hydrogenating the above-mentioned substance to be hydrogenated, and examples thereof include cyclohexane, methylcyclohexane, dimethylcyclohexane, and piperidine.

Although only one electrolytic bath 2 is shown in FIG. 1, the organic hydride producing system 1 may include a plurality of electrolytic baths 2. In this case, the respective electrolytic baths 2 are arranged in the same direction so that, for example, the anode chamber 16 and the cathode chamber 18 are arranged in the same direction, and are stacked with an energizing plate interposed between the adjacent electrolytic baths 2. Thus, the respective electrolytic baths 2 are electrically connected in series. The energizing plate is made of a conductive material such as metal. The respective electrolytic baths 2 may be connected in parallel, or may be arranged in a combination of series connection and parallel connection.

In the electrolytic bath 2, a reaction that occurs when toluene (TL) is used as an example of the substance to be hydrogenated is as follows. The organic hydride obtained in a case where toluene is used as the substance to be hydrogenated is methylcyclohexane (MCH).

<Electrode Reaction in Anode Electrode>

$$3H_2O \rightarrow 3/2O_2 + 6H^+ + 6e^-$$

<Electrode Reaction in Cathode Electrode>

$$TL + 6H^+ + 6e^- \rightarrow MCH$$

That is, the electrode reaction in the anode electrode 12 and the electrode reaction in the cathode electrode 14 proceed in parallel. Protons generated by electrolysis of water in the anode electrode 12 are supplied to the cathode electrode 14 via the membrane 20. The electrons generated by electrolysis of water are supplied to the cathode electrode 14 via the end plate 22*a*, an external circuit, and the end plate 22*b*. The protons and electrons supplied to the cathode electrode 14 are used for hydrogenation of toluene in the cathode electrode 14. As a result, methylcyclohexane is generated.

Therefore, according to the organic hydride producing system 1 according to the present embodiment, the electrolysis of water and the hydrogenation reaction of the substance to be hydrogenated can be performed in one step. Therefore, it is possible to enhance the production efficiency of the organic hydride as compared with a conventional technique in which the organic hydride is produced by a two-stage process of a process of producing hydrogen by water electrolysis or the like and a process of chemically hydrogenating the substance to be hydrogenated in a reactor such as a plant. In addition, since a reactor for performing chemical hydrogenation, a high-pressure vessel for storing hydrogen produced by water electrolysis, or the like is unnecessary, a significant reduction in facility cost can be achieved.

In the cathode electrode 14, the following hydrogen gas generation reaction may occur as a side reaction together with the hydrogenation reaction of the substance to be hydrogenated as the main reaction. As the supply amount of the substance to be hydrogenated to the catalyst layer 14*a* becomes insufficient, this side reaction is likely to occur.

<Side Reaction That May Occur at Cathode Electrode>

$$2H^+ + 2e^- \rightarrow H_2$$

The power supply 4 is a DC power supply that supplies power to the electrolytic bath 2. When power is supplied from the power supply 4 to the electrolytic bath 2, a predetermined electrolysis voltage is applied between the anode electrode 12 and the cathode electrode 14 of the electrolytic bath 2, and an electrolysis current flows. The power supply 4 receives power supply from a power supply device 34 and supplies the power to the electrolytic bath 2. The power supply device 34 can be constituted by a power generation apparatus that generates power using renewable energy, for example, a wind power generation apparatus, a solar power generation apparatus, or the like. Note that the power supply device 34 is not limited to a power generation apparatus using renewable energy, and may be a system power supply, a power storage apparatus storing power from the renewable energy power generation apparatus or the system power supply, or the like. In addition, a combination of two or more of them may be used.

The anolyte supply device 6 supplies the anolyte to the anode chamber 16. The anolyte supply device 6 includes an anolyte tank 36, a first anode pipe 38, a second anode pipe 40, and an anode pump 42. The anode pump 42 can be constituted by a known pump such as a gear pump or a cylinder pump. The anolyte supply device 6 may be caused to flow through the anolyte using a liquid feeding device other than the pump.

The anolyte tank 36 stores the anolyte to be supplied to the anode chamber 16. The anolyte tank 36 is connected to the anode chamber 16 by the first anode pipe 38. The first anode pipe 38 has one end connected to the anolyte tank 36 and the other end connected to the first anode opening 26. The anode pump 42 is provided in the middle of the first anode pipe 38. The anolyte tank 36 is also connected to the anode chamber 16 by the second anode pipe 40. The second anode pipe 40 has one end connected to the second anode opening 28 and the other end connected to the anolyte tank 36.

The anolyte in the anolyte tank 36 flows into the anode chamber 16 from the first anode opening 26 via the first anode pipe 38 by driving of the anode pump 42. The anolyte is supplied to the anode chamber 16 and subjected to an electrode reaction in the anode electrode 12. The anolyte in the anode chamber 16 is returned to the anolyte tank 36 via the second anode pipe 40. In the anode electrode 12, oxygen gas is generated by the electrode reaction. Therefore, oxygen gas is mixed into the anolyte discharged from the anode chamber 16. The anolyte tank 36 also functions as a gas-liquid separator, separates oxygen gas in the anolyte from the anolyte, and discharges the oxygen gas to the outside of the system. A gas-liquid separation tank may be provided in the middle of the second anode pipe 40.

The catholyte supply device 8 supplies the catholyte to the cathode chamber 18. The catholyte supply device 8 can supply any catholyte selected from a plurality of catholytes having different concentrations of substances to be hydrogenated to the cathode chamber 18. The catholyte supply device 8 of the present embodiment includes a plurality of storages 44, a first cathode pipe 46, a second cathode pipe 48, a cathode pump 50, and a first on-off valve 52 to a tenth on-off valve 70. The cathode pump 50 can be constituted by a known pump such as a gear pump or a cylinder pump. The catholyte supply device 8 may be caused to flow through the catholyte using a liquid feeding device other than the pump. The first on-off valve 52 to the tenth on-off valve 70 can be constituted by a known valve such as an electromagnetic valve or an air drive valve. The number of catholytes selected is not limited to one. If a plurality of the catholytes is selected, they may be mixed in line by a line blending method and supplied to the cathode chamber 18.

The plurality of storages 44 individually (by concentration) store a plurality of catholytes having different concentrations of substances to be hydrogenated. The catholyte supply device 8 of the present embodiment includes, as the plurality of storages 44, an ultra-high concentration storage 44*a*, a high concentration storage 44*b*, a medium concentration storage 44*c*, a low concentration storage 44*d*, and an ultra-low concentration storage 44*e*. The concentration of a substance to be hydrogenated in the catholyte stored in each of the storages 44 is the highest in the ultra-high concentration storage 44*a*, the second highest in the high concentration storage 44*b*, the third highest in the medium concentration storage 44*c*, the fourth highest in the low concentration storage 44*d*, and the lowest in the ultra-low concentration storage 44*e*. The concentration of a substance to be hydrogenated in each catholyte is calculated by a ratio between the substance to be hydrogenated and an organic hydride which is a hydrogenated product of a substance to be hydrogenated in the catholyte. In the present embodiment, the case where the number of the plurality of storages 44 is five has been exemplified, but the present invention is not limited thereto. The plurality of storages 44 may be two or more, or three or more. The upper limit number of the plurality of storages 44 is not particularly limited, but may be, for example, six or less, five or less, or four or less.

For example, in a preparation stage before the operation of the organic hydride producing system 1 is started, the catholyte whose concentration of a substance to be hydrogenated is adjusted in advance is stored in the ultra-high concentration storage 44*a* to the ultra-low concentration storage 44*e*. As an example, the ultra-high concentration storage 44*a* stores a catholyte having a concentration of a substance to be hydrogenated of 100 mol %. The ultra-low concentration storage 44*e* stores a catholyte having a concentration of a substance to be hydrogenated of 5 mol %. The high concentration storage 44*b*, the medium concentration storage 44*c*, and the low concentration storage 44*d* store catholytes having concentrations of substances to be hydrogenated of 75 mol %, 50 mol %, and 25 mol %, respectively. The concentration of a substance to be hydrogenated of 5 mol % is an example of a target concentration to be finally reached when the catholyte is electrolyzed in the electrolytic bath 2, but this numerical value may vary to any value from the viewpoint of energy efficiency of the present system. The concentration of a substance to be hydrogenated in the catholyte stored in the ultra-low concentration storage 44*e* may be 0 mol %. The concentration of a substance to be hydrogenated of each catholyte can be appropriately set based on experiments or simulations.

In the present embodiment, the storages 44 are constituted by tanks independent from each other. However, the present invention is not limited thereto, and for example, one tank may be partitioned into a plurality of mutually independent spaces, and each space may constitute the storage 44.

The plurality of storages 44 are connected to the cathode chamber 18 by the first cathode pipe 46. One end of the first cathode pipe 46 is branched into a plurality of parts and connected to each storage 44, and the other end is connected to the first cathode opening 30. One end of the first cathode pipe 46 of the present embodiment is branched into five of a first branch pipe 46*a* to a fifth branch pipe 46*e*. The first branch pipe 46*a* to the fifth branch pipe 46*e* are disposed in this order, and the first branch pipe 46*a* is disposed closest to the first cathode opening 30. The first branch pipe 46*a* is connected to the ultra-high concentration storage 44*a*, the second branch pipe 46*b* is connected to the high concentration storage 44*b*, the third branch pipe 46*c* is connected to the medium concentration storage 44*c*, the fourth branch pipe 46*d* is connected to the low concentration storage 44*d*, and the fifth branch pipe 46*e* is connected to the ultra-low concentration storage 44*e*. The arrangement order of the ultra-high concentration storage 44*a* to the ultra-low concentration storage 44*e* is not particularly limited.

The cathode pump 50 is provided in a region on the first cathode opening 30 side of the first branch pipe 46*a* in the middle of the first cathode pipe 46. The first on-off valve 52 is provided in the middle of the first branch pipe 46*a*. The second on-off valve 54 is provided in the middle of the second branch pipe 46*b*. The third on-off valve 56 is provided in the middle of the third branch pipe 46*c*. The fourth on-off valve 58 is provided in the middle of the fourth branch pipe 46*d*. The fifth on-off valve 60 is provided in the middle of the fifth branch pipe 46*e*.

The plurality of storages 44 are also connected to the cathode chamber 18 by the second cathode pipe 48. One end of the second cathode pipe 48 is connected to the second cathode opening 32, and the other end is branched into a plurality of parts and connected to each storage 44. The other end of the second cathode pipe 48 of the present embodiment is branched into five of a sixth branch pipe 48*a* to a tenth branch pipe 48*e*. The sixth branch pipe 48*a* is connected to the ultra-high concentration storage 44*a*, the seventh branch pipe 48*b* is connected to the high concentration storage 44*b*, the eighth branch pipe 48*c* is connected to the medium concentration storage 44*c*, the ninth branch pipe 48*d* is connected to the low concentration storage 44*d*, and the tenth branch pipe 48*e* is connected to the ultra-low concentration storage 44*e*.

The sixth on-off valve 62 is provided in the middle of the sixth branch pipe 48*a*. The seventh on-off valve 64 is provided in the middle of the seventh branch pipe 48*b*. The eighth on-off valve 66 is provided in the middle of the eighth branch pipe 48*c*. The ninth on-off valve 68 is provided in the middle of the ninth branch pipe 48*d*. The tenth on-off valve 70 is provided in the middle of the tenth branch pipe 48*e*.

The catholyte in each storage 44 flows into the cathode chamber 18 from the first cathode opening 30 via the first cathode pipe 46 by driving of the cathode pump 50. Which storage 44 supplies the catholyte to the cathode chamber 18 can be switched according to the open/close states of the first on-off valve 52 to the fifth on-off valve 60. The catholyte is supplied to the cathode chamber 18 and subjected to an electrode reaction in the cathode electrode 14. The catholyte in the cathode chamber 18 is returned to each storage 44 via the second cathode pipe 48. Which storage 44 the catholyte is returned to can be switched according to the open/close states of the sixth on-off valve 62 to the tenth on-off valve 70.

As described above, in the cathode electrode 14, hydrogen gas may be generated by a side reaction. When a side reaction occurs, hydrogen gas is mixed in the catholyte discharged from the cathode chamber 18. Each storage 44 also functions as a gas-liquid separator, separates hydrogen gas in the catholyte from the catholyte, and discharges the hydrogen gas to the outside of the system. A gas-liquid separation tank may be provided in the middle of the second cathode pipe 48. When the protons travel from the anode chamber 16 side to the cathode chamber 18 side through the membrane 20, they travel together with water molecules. Therefore, water is mixed in the catholyte discharged from the cathode chamber 18. To deal with this mixed water, an oil water separation tank may be provided in the middle of the second cathode pipe 48 to separate water in the catholyte from the catholyte.

The organic hydride producing system 1 also includes a concentration sensor 72 that detects the concentration of a substance to be hydrogenated in the catholyte stored in each storage 44. The concentration sensor 72 can be constituted by a known sensor, and an installation position thereof can be appropriately selected according to a detection method of the sensor or the like. For example, the concentration sensor 72 may be constituted by an analytical instrument such as a gas chromatograph installed in each storage 44 or each branch pipe (in-line measurement). Further, for example, the concentration sensor 72 may detect the concentration of a substance to be hydrogenated of the catholyte in each storage 44 based on the color of the catholyte to which a coloring agent (for example, a transition metal compound such as $FeCl_3$) that colors due to coexistence with the aromatic ring of the substance to be hydrogenated is added. The concentration sensor 72 repeatedly transmits a signal indicating the detection result to the control device 10.

In the present embodiment, a part of the pipe connecting each storage 44 and the cathode chamber 18 is shared. That is, one end of the first cathode pipe 46 is branched and connected to each storage 44. The other end of the second cathode pipe 48 is branched and connected to each storage 44. However, the present invention is not limited to this configuration, and the pipe connecting each storage 44 and the cathode chamber 18 may be independent for each storage 44.

The control device 10 controls the supply of power from the power supply 4 to the electrolytic bath 2. The potentials of the anode electrode 12 and the cathode electrode 14 are controlled by the control device 10. The control device 10 is realized by an element or a circuit such as a CPU or a memory of a computer as a hardware configuration, and is realized by a computer program or the like as a software configuration, but is shown as a functional block realized by cooperation between them in FIG. 1. It should be naturally understood by those skilled in the art that the functional block can be realized in various forms by a combination of hardware and software.

At least one of a signal indicating the voltage of the electrolytic bath 2, a signal indicating the potential of the anode electrode 12, and a signal indicating the potential of the cathode electrode 14 is input to the control device 10 from the detector 74 provided in the electrolytic bath 2. The detector 74 can detect the potential of each electrode and the voltage of the electrolytic bath 2 by a known method. The detector 74 includes, for example, a known voltmeter.

When the detector 74 detects the potential of the anode electrode 12 or the potential of the cathode electrode 14, the reference electrode is provided in the membrane 20. The reference electrode is held at the reference electrode potential. The reference electrode is, for example, a reversible hydrogen electrode (RHE). Then, one terminal of the detector 74 is connected to the reference electrode, the other terminal is connected to the electrode to be detected, and the potential of the electrode with respect to the reference electrode is detected. In addition, when the detector 74 detects the voltage of the electrolytic bath 2, one terminal of the detector 74 is connected to the anode electrode 12, and the other terminal is connected to the cathode electrode 14, and the potential difference between both the electrodes, that is, the voltage is detected. The detector 74 transmits a signal indicating a detection result to the control device 10.

In addition, the detector 74 includes a current detector that detects a current flowing between the anode electrode 12 and the cathode electrode 14. The current detector is constituted by, for example, a known ammeter. The current value detected by the current detector is input to the control device 10. The control device 10 may hold information on the current-voltage characteristics (I-V characteristics) of the electrolytic bath 2 in advance. In a case where the control device 10 holds the information on the I-V characteristics, this information may be arbitrarily updatable. The I-V characteristics of the electrolytic bath 2 are characteristics determined according to the catalyst composition of each electrode, the types of the diffusion layer and the base material, the type of the membrane 20, the flow path structures of the anolyte and the catholyte of the electrolytic bath 2, the dimensions of each part, and the like, and can be measured and grasped in advance. In this case, the control device 10 can grasp the amount of power that can be supplied from the power supply 4 to the electrolytic bath 2 by receiving the signal indicating the amount of power supplied from the power supply device 34, and calculate the voltage value to be applied to the electrolytic bath 2 from the I-V characteristics, that is, can control the value of the current flowing in the electrolytic bath 2.

The control device 10 controls the anolyte supply device 6 and the catholyte supply device 8. Specifically, the control device 10 controls driving of the anode pump 42 and the cathode pump 50. Further, the control device 10 controls opening and closing of the first on-off valve 52 to the tenth on-off valve 70.

In the organic hydride producing system 1, in order to increase the production speed of the organic hydride, it is conceivable to apply a high voltage to the electrolytic bath 2 to increase the current (for example, current density) flowing in the electrolytic bath 2. However, when the current density of the electrolytic bath 2 is increased, the substance to be hydrogenated is insufficient, and a side reaction is likely to occur. Since an occurrence of a side reaction leads to a decrease in Faraday efficiency of the organic hydride producing system 1, it is desired to avoid the occurrence of a side reaction as much as possible.

In a state where the catholyte and the anolyte are supplied to each electrode at any flow rate, whether or not a side reaction occurs when the current density of the electrolytic bath 2 is a certain value depends on the concentration of a substance to be hydrogenated of the catholyte. Therefore, by adjusting the current density of the electrolytic bath 2 according to the concentration of a substance to be hydrogenated in the catholyte, it is possible to improve the production speed of the organic hydride while suppressing the decrease in Faraday efficiency. However, the timing of the current density increase/decrease request does not necessarily coincide with the change in the amount of power that can be supplied from the power supply 4 to the electrolytic bath 2.

For example, in a case where the power supply device 34 is a power generation apparatus that generates power using renewable energy, the amount of power generation greatly varies depending on weather conditions. For example, in the case of a solar power generation apparatus, the amount of power generation decreases when it is cloudy or after sunset. For this reason, when it is desired to increase the current density of the electrolytic bath 2, the power supply amount from the power supply device 34 may be insufficient. In addition, although the power supply amount from the power supply device 34 is sufficient, there may be a case where the current density of the electrolytic bath 2 cannot be increased because the concentration of a substance to be hydrogenated in the catholyte is low. Therefore, it is difficult to realize an efficient electrolytic reaction according to the concentration of a substance to be hydrogenated in the catholyte.

To deal with this problem, the catholyte supply device 8 according to the present embodiment includes the plurality of storages 44, that is, the ultra-high concentration storage 44*a* to the ultra-low concentration storage 44*e* as described above. The catholyte supply device 8 can supply any catholyte from a plurality of catholytes having different concentrations of substances to be hydrogenated to the cathode chamber 18. That is, the concentration of a substance to be hydrogenated of the catholyte to be supplied to the cathode chamber 18 can be switched. Then, the control device 10 controls the catholyte supply device 8 so as to supply the catholyte having a specific concentration of a substance to be hydrogenated to the cathode chamber 18.

The specific concentration of a substance to be hydrogenated is determined according to the magnitude of the current flowing in the electrolytic bath 2. That is, the lower limit value of the concentration of a substance to be hydrogenated is determined based on the magnitude of the current flowing in the electrolytic bath 2, and the specific concentration of a substance to be hydrogenated is determined based on the lower limit value. In a first example, the specific concentration of a substance to be hydrogenated is determined based on the lower limit value and the concentration of a substance to be hydrogenated of each catholyte stored in each storage 44 at the time of setting the specific concentration of a substance to be hydrogenated. In addition, as a second example, the specific concentration of a substance to be hydrogenated is determined by calculation based on the lower limit value and a predetermined margin. In the present embodiment, the first example will be described. The second example will be described in a second embodiment described later. By selecting the concentration of a substance to be hydrogenated in the catholyte to be supplied to the cathode chamber 18 according to the current density in the electrolytic bath 2 instead of adjusting the current density in the electrolytic bath 2 according to the concentration of a substance to be hydrogenated in the catholyte to be supplied to the cathode chamber 18, it is possible to increase the production speed of the organic hydride while suppressing a decrease in Faraday efficiency.

In the first example described above, the specific concentration of a substance to be hydrogenated is set by the control device 10. The control device 10 first determines a lower limit value of the concentration of a substance to be hydrogenated in the catholyte to be supplied to the cathode chamber 18 based on the magnitude of the current flowing in the electrolytic bath 2, for example, the magnitude of the current density. The current density of the electrolytic bath 2 can be grasped based on a signal received from the detector 74. In addition, the control device 10 holds the information on the I-V characteristics in advance as described above, and can calculate the voltage value to be applied to the electrolytic bath 2 by receiving a signal indicating the power supply amount from the power supply 4 or the power supply device 34. When the power supply device 34 is a combination of at least two of a renewable energy power generation apparatus, a system power supply, and a power storage apparatus, the power supply amount is a total power supply amount from the combination.

The lower limit value of the concentration of a substance to be hydrogenated is, for example, the concentration of a substance to be hydrogenated at which hydrogen gas is generated (starts to be generated). The relationship between the current density in the electrolytic bath 2 and the concentration of a substance to be hydrogenated at which the hydrogen gas is generated is determined according to the catalyst composition of each electrode, the types of the diffusion layer and the base material, the type of the membrane 20, the flow path structures of the anolyte and the catholyte of the electrolytic bath 2, the dimensions of each part, and the like, and can be measured and grasped in advance. In the measurement, the fact that the hydrogen gas starts to be generated can be confirmed, for example, visually or by automatic detection by an optical analysis instrument or the like using a difference in refractive index between the liquid and the gas.

In addition to the magnitude of the current density in the electrolytic bath 2, the control device 10 of the present embodiment determines the lower limit value of the concentration of a substance to be hydrogenated based on the decrease amount of the concentration of a substance to be hydrogenated in the cathode chamber 18. For example, the control device 10 sets the lower limit value of the concentration of a substance to be hydrogenated determined based on the magnitude of the current density of the electrolytic bath 2 as the provisional lower limit value, and adds the decrease amount of the concentration of a substance to be hydrogenated in the cathode chamber 18 to the provisional lower limit value to determine the true lower limit value.

The catholyte that has flowed into the cathode chamber 18 is subjected to an electrolytic reaction in the cathode electrode 14. Therefore, the concentration of a substance to be hydrogenated of the catholyte gradually decreases in the cathode chamber 18. By determining the lower limit value of the concentration of a substance to be hydrogenated in consideration of the decrease amount of the concentration of a substance to be hydrogenated in the cathode chamber 18, it is possible to further reduce the possibility that the substance to be hydrogenated becomes insufficient and a side reaction occurs. The decrease amount of the concentration of a substance to be hydrogenated is theoretically maximum when compared between the inlet (first cathode opening 30) and the outlet (second cathode opening 32) of the cathode chamber 18. For this reason, it is preferable to set the difference in the concentration of a substance to be hydrogenated between the inlet and the outlet of the cathode chamber 18 as the decrease amount of the concentration of a substance to be hydrogenated in the cathode chamber 18.

The flow rate of the catholyte is determined according to the cathode pump 50. The volume of the cathode chamber 18 is also determined in advance. In addition, the conversion rate from the substance to be hydrogenated to the organic hydride when the catholyte flows at a predetermined flow rate can be calculated based on the power supply amount to the electrolytic bath 2. Therefore, the control device 10 can calculate the decrease amount of the concentration of a substance to be hydrogenated in the cathode chamber 18 based on the power supply amount to the electrolytic bath 2 when the storage 44 is selected. The lower limit value may be set based only on the magnitude of the current density of the electrolytic bath 2 without considering the decrease amount of the concentration of a substance to be hydrogenated in the cathode chamber 18. In this case, the lower limit value setting process can be simplified.

Then, the control device 10 selects the storage 44 that stores the catholyte having a specific concentration of a substance to be hydrogenated from the storage 44 that stores the catholyte having a concentration of a substance to be hydrogenated equal to or more than the set lower limit value. By receiving a signal from the concentration sensor 72, the control device 10 can grasp the concentration of a substance to be hydrogenated of the catholyte stored in each storage 44. In a state where no side reaction occurs, the control device 10 can also calculate the generation amount of organic hydride from the catholyte stored in each storage 44 based on the amount of the catholyte filled in each storage 44, the supply amount of the catholyte from each storage 44 to the cathode chamber 18, and the total power supply amount to the electrolytic bath 2 while the catholyte is being supplied, and calculate the concentration of a substance to be hydrogenated of the catholyte stored in each storage 44 from the result. In this case, the concentration sensor 72 can be omitted. The supply amount of the catholyte from each storage 44 to the cathode chamber 18 can be calculated from the state of each on-off valve and the drive time of the cathode pump 50.

When a side reaction occurs, it is difficult to accurately calculate the decrease amount of the concentration of a substance to be hydrogenated in the cathode chamber 18. In consideration of such a case, it is preferable to provide a concentration sensor in the vicinity of the outlet of the cathode chamber 18 in the second cathode pipe 48. As a result, the concentration sensors 72 provided in the storages 44 can be integrated into the concentration sensor disposed in the vicinity of the outlet of the cathode chamber 18.

The control device 10 selects the storage 44 that stores the catholyte having a concentration of a substance to be hydrogenated equal to or more than the lower limit value as the storage 44 that stores the catholyte having a specific concentration of a substance to be hydrogenated. As an example, the control device 10 of the present embodiment selects the storage 44 that stores the catholyte having a concentration of a substance to be hydrogenated equal to or more than the lower limit value and closest to the lower limit value as the storage 44 that stores the catholyte having a specific concentration of a substance to be hydrogenated. As a result, the concentration of a substance to be hydrogenated in the catholyte stored in the ultra-high concentration storage 44*a* or the high concentration storage 44*b* can be easily maintained in a high concentration state. Therefore, even if the lower limit value fluctuates, the state in which the catholyte having a concentration of a substance to be hydrogenated equal to or more than the lower limit value is prepared can be maintained for a longer period of time.

The control device 10 of the present embodiment controls the catholyte supply device 8 so as to supply the catholyte from the storage 44 that stores the catholyte having a specific concentration of a substance to be hydrogenated to the cathode chamber 18. That is, the control device 10 controls each on-off valve so as to form a flow path connecting the selected storage 44 and the cathode chamber 18, and drives the cathode pump 50. When there is the storage 44 that satisfies the selection criteria of the storage 44, the control device 10 controls the catholyte supply device 8 to supply the catholyte from the storage 44. When there is no storage 44 that stores the catholyte in which the concentration of a substance to be hydrogenated is equal to or more than the lower limit value, the control device 10 controls the catholyte supply device 8 to supply the catholyte from, for example, the storage 44 that stores the catholyte having the highest concentration of substance to be hydrogenated. In this case, the control device 10 controls the power supply 4 so as to achieve a current density at which generation of hydrogen gas does not occur at the concentration of a substance to be hydrogenated of the supplied catholyte.

Note that, also in the first example, a margin may be added to the lower limit value similarly to the second example described later. That is, the control device 10 may add a predetermined margin to a lower limit value based only on the magnitude of the current flowing in the electrolytic bath 2 or a lower limit value determined based on the magnitude of the current and the concentration decrease amount in the cathode chamber 18, and determine the specific concentration of a substance to be hydrogenated based on the concentration of a substance to be hydrogenated obtained as a result. The predetermined margin can be appropriately set on the basis of an experiment or a simulation.

For example, when the specific concentration of a substance to be hydrogenated is 100 mol %, the control device 10 drives the cathode pump 50 with the first on-off valve 52 in an open state and the second on-off valve 54 to the fifth on-off valve 60 in a closed state. As a result, the catholyte stored in the ultra-high concentration storage 44*a* and having a concentration of a substance to be hydrogenated of 100 mol % is supplied to the cathode chamber 18. The control device 10 opens the sixth on-off valve 62 and closes the seventh on-off valve 64 to the tenth on-off valve 70 to return the catholyte discharged from the cathode chamber 18 to the ultra-high concentration storage 44*a* as a supply source. This makes it possible to avoid an occurrence of deviation in the amount of the catholyte in each storage 44.

It is possible to appropriately set to which storage 44 the catholyte discharged from the cathode chamber 18 is returned. For example, when it is desired to avoid a decrease in the concentration of a substance to be hydrogenated in the catholyte stored in the ultra-high concentration storage 44*a*, the catholyte can be supplied from the ultra-high concentration storage 44*a* to the cathode chamber 18 and returned to the storage 44 other than the ultra-high concentration storage 44*a*. At this time, when the concentration of a substance to be hydrogenated in the catholyte in the storage 44 to which the catholyte is returned is lower than the concentration of a substance to be hydrogenated in the catholyte at the cathode chamber outlet, the concentration of a substance to be hydrogenated in the catholyte in the storage 44 can be increased by this operation. However, when the storage 44 that supplies the catholyte to the cathode electrode 14 is different from the storage 44 that returns the catholyte from the cathode chamber 18, the amount of catholyte stored in each storage 44 is biased. Therefore, it is preferable that a known volume detector or mass detector such as a liquid level gauge is installed in each storage 44 to grasp the amount of the catholyte.

The control device 10 repeats the setting of the lower limit value of the concentration of a substance to be hydrogenated and the selection of the storage 44 at a predetermined timing. For example, the control device 10 repeats the setting of the lower limit value of the concentration of a substance to be hydrogenated and the selection of the storage 44 at a predetermined time period. The execution timings of the setting of the lower limit value and the selection of the storage selection can be appropriately set on the basis of an experiment or a simulation.

In the present embodiment, the ultra-high concentration storage 44*a* to the ultra-low concentration storage 44*e* are prepared in advance. Therefore, at the start of the operation of the organic hydride producing system 1, a state in which any catholyte selected from a plurality of catholytes having different concentrations of substances to be hydrogenated can be supplied to the cathode chamber 18 is established. However, the present invention is not limited to this configuration, and for example, the priority of use of each storage 44 may be set in advance, and the catholyte having the same concentration of a substance to be hydrogenated may be stored in all the storages 44 before the operation of the organic hydride producing system 1 is started. In this case, as the operation time elapses, the concentration of a substance to be hydrogenated in the catholyte starts to vary among the storages 44. As a result, it is possible to obtain a state in which any catholyte selected from a plurality of catholytes having different concentrations of substances to be hydrogenated can be supplied to the cathode chamber 18.

The present inventor verified the effect obtained by the above-described control based on the following tests. The tests described below are exemplary only and are not intended to limit the present invention in any way.

Test 1: Evaluation of Relationship Between Current Density and Concentration of Substance to be Hydrogenated at which Hydrogen is Generated First, an electrolytic bath including an anode electrode (geometric area: 100 $cm^2$) made of iridium oxide ($IrO_2$), an anode chamber (volume: 40 mL), a cathode electrode (geometric area: 100 $cm^2$) made of platinum ruthenium-supported carbon (Pt Ru/C), a cathode chamber (volume: 10 mL), a membrane made of Nafion (registered trademark) N 117 (manufactured by DuPont), and a reference electrode (standard hydrogen electrode) inserted into the cathode chamber was prepared.

Using this electrolytic bath, constant current electrolysis (preliminary operation) was performed at a current density of 0.2 $A/cm^2$ for 10 minutes. During the electrolysis, the entire electrolytic bath was kept at 60° C. A 1 M aqueous sulfuric acid solution was caused to flow through the anode chamber at a flow rate of 20 mL/min. The catholyte was caused to flow from the storage to the cathode chamber at a flow rate of 20 mL/min. The catholyte was 0.5 mol of 100 mol % toluene.

After the preliminary operation, the current density was increased to 0.7 $A/cm^2$ to start constant current electrolysis. Conditions other than the current density were the same as those in the preliminary operation. After the start of electrolysis, when bubbles (hydrogen gas generated in a side reaction) were confirmed at the outlet of the electrolytic bath, the current density was reduced by 0.05 $A/cm^2$ to 0.65 $A/cm^2$. In addition, with the adjustment of the current density, 0.2 mL of the catholyte was sampled from the storage, and the concentrations of toluene and methylcyclohexane were measured by gas chromatography. Then, the toluene concentration at which bubbles were visually confirmed was determined to be the concentration at which hydrogen gas was generated at the current density, in other words, the concentration at which the Faraday efficiency decreased.

Figure 2:
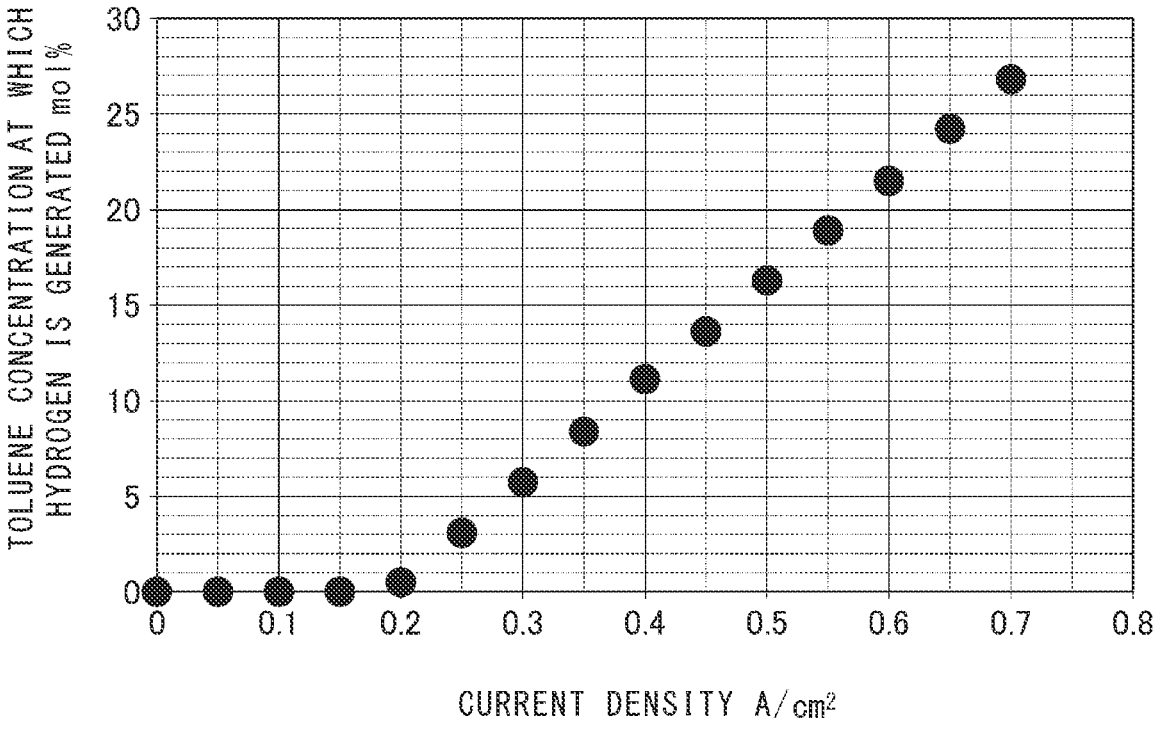
FIG. 2 is a diagram showing a relationship between a current density in an electrolytic bath and a toluene concentration at which hydrogen gas is generated.

Constant current electrolysis at a current density of 0.65 $A/cm^2$ was continued and the current density was reduced by 0.05 $A/cm^2$ when bubbles were confirmed at the outlet of the electrolytic bath. Further, 0.2 mL of the catholyte was sampled from the storage, and the concentrations of toluene and methylcyclohexane were measured. Then, this measurement operation was repeated at a current density of 0.2 $A/cm^2$ until bubbles were confirmed. The measurement results are shown in FIG. 2. FIG. 2 is a diagram showing the relationship between the current density in the electrolytic bath and the toluene concentration at which hydrogen gas is generated. From FIG. 2, it was confirmed that the relationship between the current density in the electrolytic bath and the concentration of a substance to be hydrogenated at which hydrogen is generated can be grasped in advance by Test 1. In FIG. 2, the maximum value of the current density is 0.7 $A/cm^2$, but this is due to the restriction of an evaluation device, and the upper limit of the current density is not intended to be limited to 0.7 $A/cm^2$.

Test 2: Evaluation of I-V Characteristics

Figure 3:
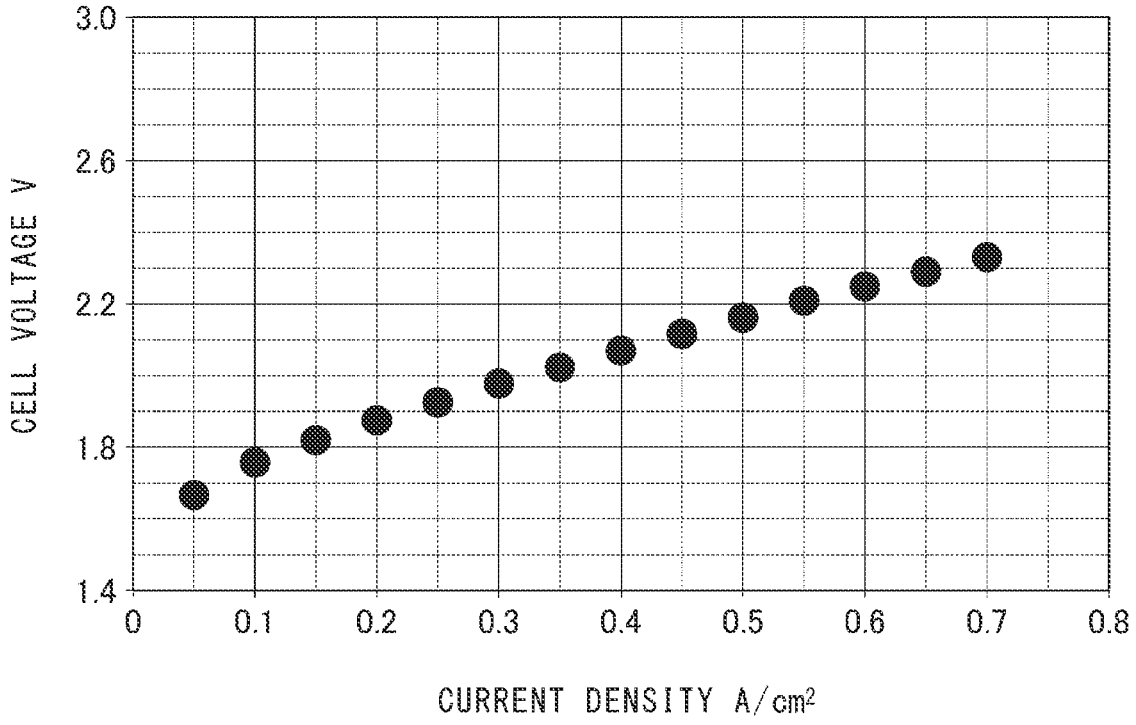
FIG. 3 is a diagram showing I-V characteristics of an electrolytic bath.

A preliminary operation was performed in the same electrolytic bath and reaction conditions as in Test 1 except that 2.056 mol of 100 mol % toluene was used as a catholyte. After the preliminary operation, constant current electrolysis at a current density of 0.05 A/cm$^2$ was performed for 3 minutes, and the cell voltage at that time was measured. Conditions other than the current density were the same as those in the preliminary operation. Thereafter, the current density was increased by 0.05 A/cm$^2$, constant current electrolysis was performed at a current density of 0.1 A/cm$^2$ for 3 minutes, and the cell voltage at that time was measured. Then, this measurement operation was repeated until the current density reached 0.7 A/cm$^2$. The I-V characteristics of the electrolytic bath were evaluated by the above measurement operation. The evaluation results are shown in FIG. 3. FIG. 3 is a diagram showing I-V characteristics of the electrolytic bath. From FIG. 3, it was confirmed that the I-V characteristics of the electrolytic bath can be grasped in advance by Test 2.

Figure 4:
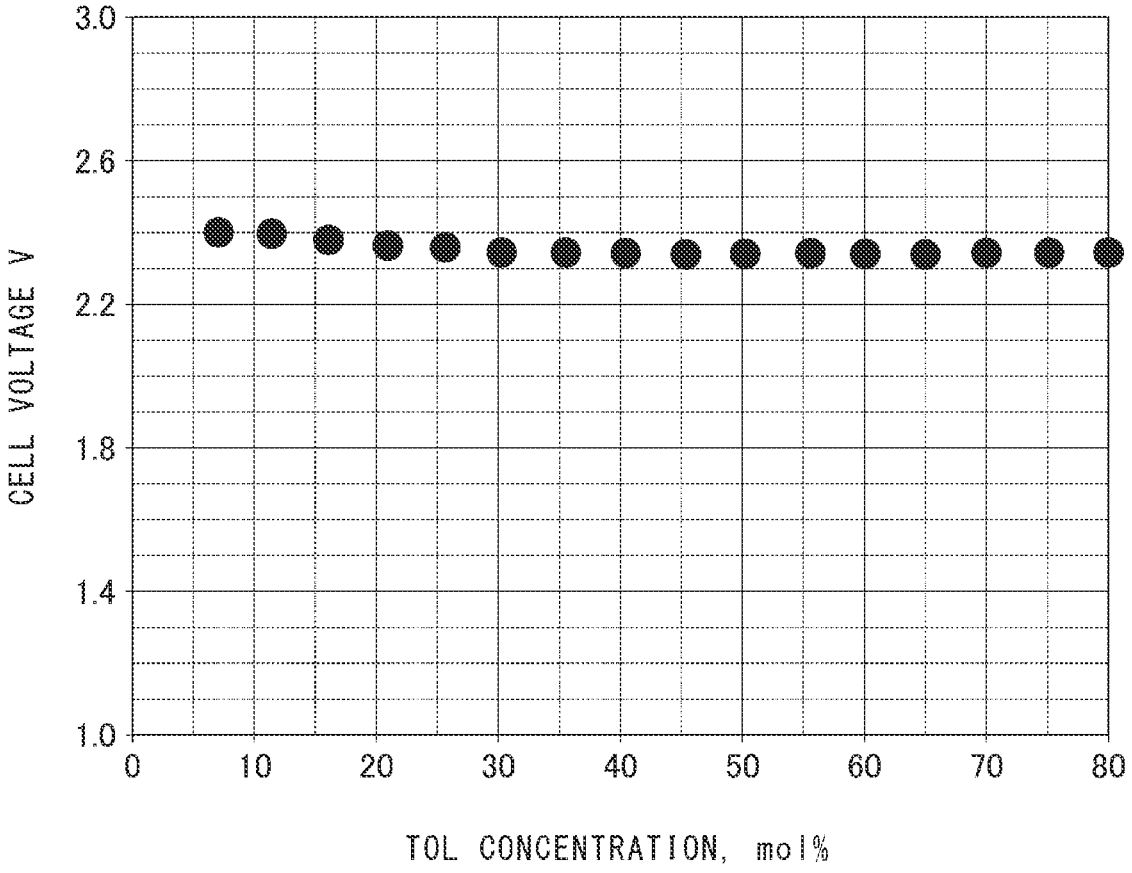
FIG. 4 is a diagram showing a relationship between the toluene concentration and a cell voltage.

Test 3: Evaluation of Influence of Concentration of Substance to be Hydrogenated on Cell Voltage Using the electrolytic bath after performing Test 2, constant current electrolysis at a current density of 0.7 A/cm$^2$ was performed for 243 minutes. Conditions other than the current density were the same as those in the preliminary operation. Approximately every 827 seconds from the start of electrolysis, 0.2 mL of the catholyte was sampled from the storage, and the concentrations of toluene and methylcyclohexane were measured by gas chromatography. The electrolysis was terminated when 243 minutes elapsed from the start of the electrolysis. The catholyte in the storage after completion of the electrolysis was also sampled to measure the concentrations of toluene and methylcyclohexane. The measurement results are shown in FIG. 4. FIG. 4 is a diagram showing the relationship between the toluene concentration and the cell voltage.

From the results of Test 1, it has been found that when constant current electrolysis is performed at a current density of 0.7 A/cm$^2$, hydrogen is generated and the Faraday efficiency decreases when the toluene concentration becomes 27 mol % or less. From FIG. 4, it has been confirmed that when electrolysis proceeds in a state where the toluene concentration exceeds 27 mol %, that is, the Faraday efficiency is about 100%, the cell voltage in the electrolytic bath hardly increases. The increase amount of the cell voltage until the toluene concentration decreased from 100 mol % to 30 mol % was only 10 mV. On the other hand, it has been confirmed that when the electrolysis proceeds in a state where the toluene concentration is 27 mol % or less, that is, the Faraday efficiency decreases, the increase amount of the cell voltage increases as the toluene concentration decreases.

Since the increase in the cell voltage was only 10 mV in the range of the concentration of a substance to be hydrogenated where hydrogen generation was not observed, it was confirmed that the influence of the concentration of a substance to be hydrogenated on the I-V characteristics was negligible in the control according to the present embodiment. In consideration of the increase of 10 mV, the cell voltage in the I-V characteristics shown in FIG. 2 is corrected to a value higher by 10 mV, more preferably 20 mV as a whole, and the modified value is used for determining the current density of the electrolytic bath, so that the possibility that the Faraday efficiency decreases can be further reduced. In addition, from FIG. 4, it has been confirmed that when electrolysis proceeds in a range of the concentration of a substance to be hydrogenated where hydrogen generation is not observed, the concentration of a substance to be hydrogenated decreases by about 5 mol % approximately every 827 seconds.

Test 4: Confirmation of Effect of Selection Control of Storage According to Embodiment Example 1

A preliminary operation was performed in the same electrolytic bath and reaction conditions as in Test 1 except that a liquid mixture of 0.25 mol of toluene and 0.25 mol of methylcyclohexane (toluene concentration: 50 mol %, methylcyclohexane concentration: 50 mol %) was used as a catholyte. After the preliminary operation, constant current electrolysis at a current density of 0.7 A/cm$^2$ was performed for 10 minutes. After completion of the electrolysis, 0.2 mL of the catholyte was sampled from the storage, and the concentrations of toluene and methylcyclohexane were measured by gas chromatography. As a result, the toluene concentration decreased to 35.5 mol %, and the conversion rate was 14.5 mol %.

The average cell voltage during constant current electrolysis was 2.341 V. In addition, it was confirmed that electrolysis proceeded at a Faraday efficiency of 100%. From the flow of toluene at a flow rate of 20 mL/min and the volume of the cathode chamber, it was confirmed that the toluene concentration at the outlet of the cathode chamber was lower by 3.9 mol % than that at the inlet. In addition, since the electrode area is 100 cm$^2$, the current value is 70 A. Therefore, electrolysis was performed with power of 163.87 W (=70 A×2.341 V). That is, when the power supply device can continuously supply power of 163.87 W for 10 minutes, by selecting a storage that stores a catholyte having a toluene concentration of 50 mol % at a current density of 0.7 A/cm$^2$, it is possible to improve the production speed of an organic hydride while suppressing a decrease in Faraday efficiency.

Comparative Example 1

A preliminary operation and constant current electrolysis at 0.7 A/cm$^2$ were performed for 10 minutes in the same manner as in Example 1 except that a liquid mixture of 0.15 mol of toluene and 0.35 mol of methylcyclohexane (toluene concentration: 30 mol %, methylcyclohexane concentration: 70 mol %) was used as a catholyte. After completion of the electrolysis, the toluene concentration decreased to 19.2 mol % and the conversion rate was 10.8 mol %. The average cell voltage during constant current electrolysis was 2.361 V. In addition, it was confirmed that electrolysis proceeded at a Faraday efficiency of 74%. Since the current value is 70 A, electrolysis was performed with power of 165.27 W (=70 A×2.361 V). That is, when the power supply device can continuously supply power of 165.27 W for 10 minutes, if a storage that stores a catholyte having a toluene concentration of 30 mol % at a current density of 0.7 A/cm$^2$ is selected, the Faraday efficiency decreases.

Example 2

A test was performed in the same manner as in Comparative Example 1 except that constant current electrolysis after the preliminary operation was performed at 0.4 A/cm$^2$. After completion of the electrolysis, the toluene concentration decreased to 21.7 mol % and the conversion rate was 8.3 mol %. The average cell voltage during constant current electrolysis was 2.077 V. In addition, it was confirmed that electrolysis proceeded at a Faraday efficiency of 100%. Since the current value is 40 A, electrolysis was performed with power of 83.08 W (=40 A×2.077 V). That is, when the power supply device can continuously supply power of 83.08 W for 10 minutes, by selecting a storage that stores a catholyte having a toluene concentration of 30 mol % at a current density of 0.4 A/cm$^2$, it is possible to improve the production speed of an organic hydride while suppressing a decrease in Faraday efficiency.

Comparison among Example 1, Comparative Example 1, and Example 2 showed that by selecting the concentration of a substance to be hydrogenated in the catholyte to be supplied to the cathode chamber according to the power supply amount from the power supply device to the electrolytic bath, it was possible to achieve both the suppression of the decrease in Faraday efficiency and the improvement in production speed of an organic hydride. In Example 1, the difference in concentration of a substance to be hydrogenated between the inlet and the outlet of the cathode chamber was 3.9 mol %. For this reason, in the case of performing electrolysis at a current density of 0.7 A/cm$^2$ using the electrolytic bath of Example 1, when the lower limit value of the concentration of a substance to be hydrogenated is determined, it is preferable to set the concentration of a substance to be hydrogenated higher by 3.9 mol % or more than the concentration of a substance to be hydrogenated determined from the magnitude of the current flowing in the electrolytic bath 2 as the lower limit value.

Figure 5:
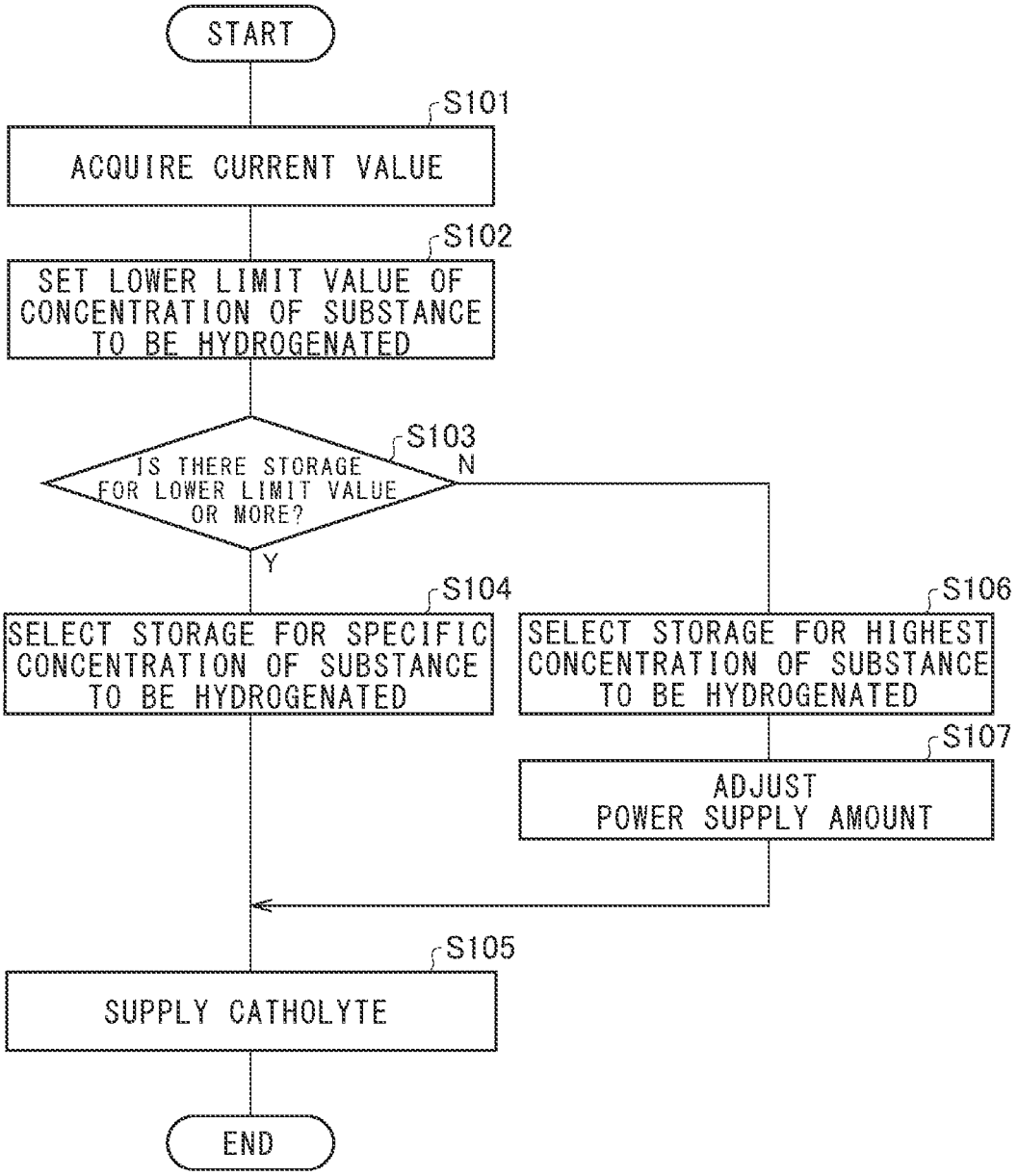
FIG. 5 is a flowchart showing an example of selection control of a storage.

Hereinafter, selection control of the storage will be described. FIG. 5 is a flowchart showing an example of selection control of the storage. This control flow is repeatedly executed by the control device 10 at a predetermined timing.

First, the control device 10 acquires a current value (current density) of the electrolytic bath 2 based on signals received from the detector 74, the power supply 4, the power supply device 34, and the like (S101). Next, the control device calculates a decrease amount of the concentration of a substance to be hydrogenated in the cathode chamber 18 from the acquired current value. Then, the lower limit value of the concentration of a substance to be hydrogenated of the catholyte to be supplied to the electrolytic bath 2 is set based on the current value and the decrease amount (S102).

Based on the signals received from the concentration sensor 72, the control device 10 determines whether there is the storage 44 that stores the catholyte having a concentration of a substance to be hydrogenated equal to or more than the set lower limit value (S103). When there is the corresponding storage 44 (Y in S103), the control device 10 selects the storage 44 as the storage 44 that stores the catholyte having a specific concentration of a substance to be hydrogenated (S104). When there are a plurality of corresponding storages 44, the control device 10 selects the storage 44 that stores the catholyte having a concentration of a substance to be hydrogenated equal to or more than the lower limit value and closest to the lower limit value. Then, the control device 10 controls each on-off valve and the cathode pump 50 to supply the catholyte from the selected storage 44 to the cathode chamber 18 (S105), and ends this routine.

When there is no corresponding storage 44 (N in S103), the control device 10 selects the storage 44 that stores the catholyte having the highest concentration of a substance to be hydrogenated (S106). In addition, the control device 10 adjusts the power supply amount from the power supply 4 to the electrolytic bath 2 according to the concentration of a substance to be hydrogenated in the selected storage 44 (S107). Then, the control device 10 controls each on-off valve and the cathode pump 50 to supply the catholyte from the selected storage 44 to the cathode chamber 18 (S105), and ends this routine.

As described above, the organic hydride producing system 1 according to the present embodiment includes the electrolytic bath 2, the catholyte supply device 8, and the control device 10. The electrolytic bath 2 includes the anode electrode 12, the cathode electrode 14, the anode chamber 16, the cathode chamber 18, and the membrane 20. The anode electrode 12 oxidizes water in the anolyte to generate protons. The cathode electrode 14 hydrogenates a substance to be hydrogenated in the catholyte with protons to generate an organic hydride. The anode chamber 16 accommodates the anode electrode 12. The cathode chamber 18 accommodates the cathode electrode 14. The membrane 20 partitions the anode chamber 16 and the cathode chamber 18, and moves protons from the anode chamber 16 side to the cathode chamber 18 side. The catholyte supply device 8 can supply any catholyte selected from a plurality of catholytes having different concentrations of substances to be hydrogenated to the cathode chamber 18. The control device 10 controls the catholyte supply device 8 so as to supply the catholyte having a specific concentration of a substance to be hydrogenated determined according to the magnitude of the current flowing in the electrolytic bath 2 to the cathode chamber 18.

As described above, by switching the concentration of a substance to be hydrogenated in the catholyte to be supplied to the cathode chamber 18 according to the magnitude of the current flowing in the electrolytic bath 2, it is possible to improve the production speed of the organic hydride while suppressing the decrease in Faraday efficiency of the organic hydride producing system 1.

The catholyte supply device 8 of the present embodiment includes the plurality of storages 44 that individually store a plurality of catholytes. The control device 10 determines the lower limit value of the concentration of a substance to be hydrogenated of the catholyte to be supplied to the cathode chamber 18 based on the magnitude of the current flowing in the electrolytic bath 2. Then, the storage 44 that stores the catholyte having a specific concentration of a substance to be hydrogenated is selected from the storages 44 that store the catholyte having a concentration of a substance to be hydrogenated equal to or more than the lower limit value. Subsequently, the control device 10 controls the catholyte supply device 8 to supply the catholyte from the selected storage 44 to the cathode chamber 18.

As described above, by individually storing a plurality of catholytes having different concentrations of substances to be hydrogenated and selecting a catholyte suitable for the magnitude of the current flowing in the electrolytic bath 2, the concentration of a substance to be hydrogenated in the catholyte can be quickly switched with respect to the fluctuation of the power supply amount from the power supply device 34. Therefore, the production speed of the organic hydride can be further improved.

In addition to the magnitude of the current flowing in the electrolytic bath 2, the control device 10 of the present embodiment determines the lower limit value based on the decrease amount of the concentration of a substance to be hydrogenated in the cathode chamber 18. As a result, the possibility that the Faraday efficiency of the organic hydride producing system 1 decreases can be further reduced.

In addition, the control device 10 of the present embodiment selects the storage 44 that stores the catholyte having a concentration of a substance to be hydrogenated equal to or more than the lower limit value and closest to the lower limit value as the storage 44 that stores the catholyte having a specific concentration of a substance to be hydrogenated. As a result, a state in which the catholyte having a concentration of a substance to be hydrogenated equal to or more than the lower limit value is prepared can be maintained for a longer period of time. Therefore, it is possible to more easily achieve both the suppression of the decrease in Faraday efficiency and the improvement in production speed of the organic hydride.

Second Embodiment

The second embodiment has substantially the same configuration as the first embodiment except for the structure of the catholyte supply device 8. Hereinafter, the present embodiment will be described focusing on a configuration different from that of the first embodiment, and common configurations will be briefly described or description thereof will be omitted.

Figure 6:
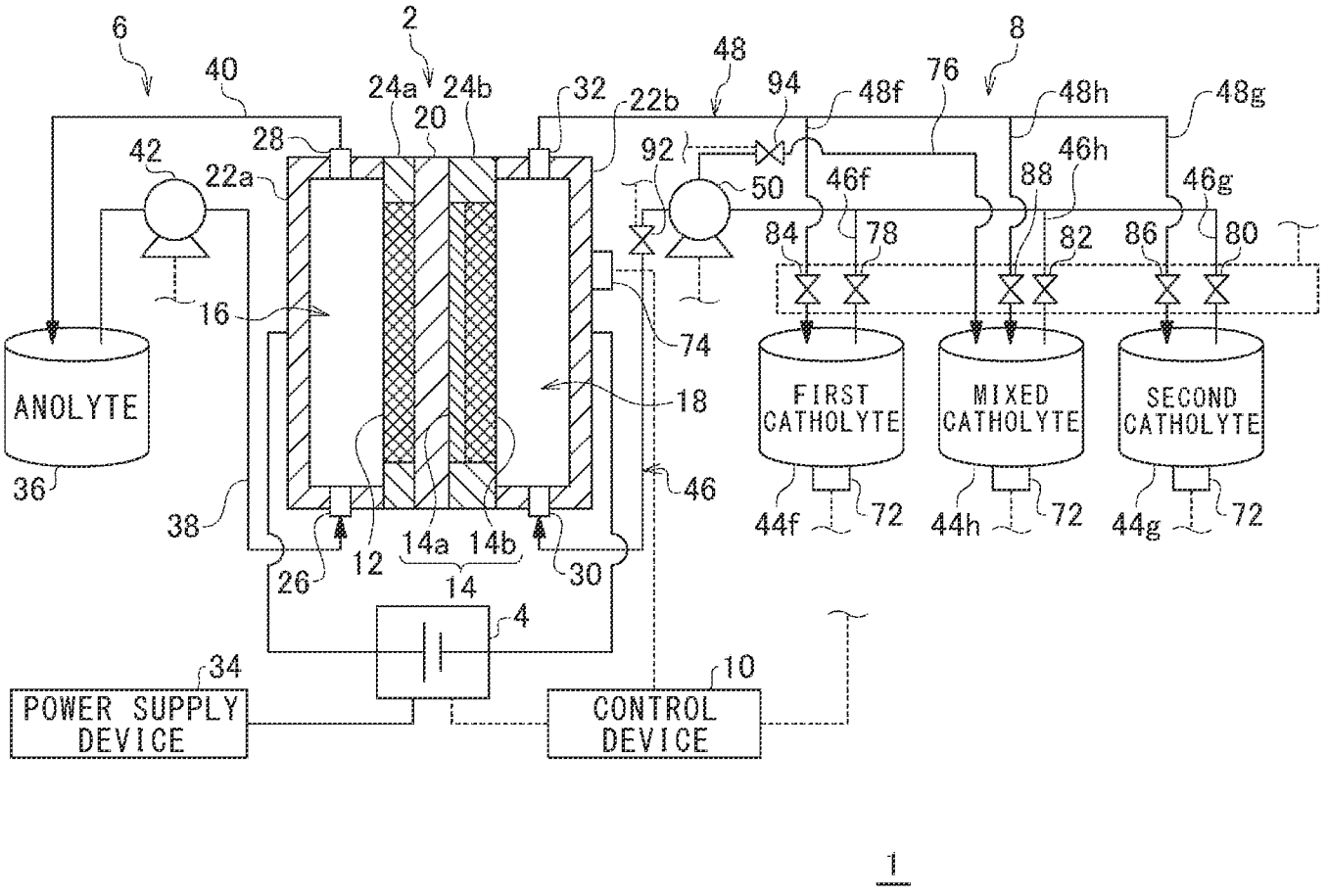
FIG. 6 is a schematic diagram of an organic hydride producing system according to a second embodiment.

FIG. 6 is a schematic diagram of an organic hydride producing system 1 according to a second embodiment. The organic hydride producing system 1 mainly includes an electrolytic bath 2, a power supply 4, an anolyte supply device 6, a catholyte supply device 8, and a control device 10. The electrolytic bath 2 includes an anode electrode 12, a cathode electrode 14, an anode chamber 16, a cathode chamber 18, and a membrane 20. The power supply 4 supplies power to the electrolytic bath 2. The anolyte supply device 6 supplies the anolyte to the anode chamber 16. The anolyte supply device 6 includes an anolyte tank 36, a first anode pipe 38, a second anode pipe 40, and an anode pump 42.

The catholyte supply device 8 supplies the catholyte to the cathode chamber 18. The catholyte supply device 8 can supply any catholyte selected from a plurality of catholytes having different concentrations of substances to be hydrogenated to the cathode chamber 18. The catholyte supply device 8 of the present embodiment includes a first storage 44*f*, a second storage 44*g*, a third storage 44*h*, a first cathode pipe 46, a second cathode pipe 48, a third cathode pipe 76, a cathode pump and an eleventh on-off valve 78 to an eighteenth on-off valve 94. The eleventh on-off valve 78 to the eighteenth on-off valve 94 can be constituted by known valves such as electromagnetic valves and air drive valves.

The first storage 44*f* stores a first catholyte having a first concentration of a substance to be hydrogenated. The second storage 44*g* stores a second catholyte having a second concentration of a substance to be hydrogenated lower than the first concentration of a substance to be hydrogenated. The third storage 44*h* can receive the supply of the first catholyte from the first storage 44*f* and the supply of the second catholyte from the second storage 44*g*. Therefore, the third storage 44*h* can store the mixed catholyte in which the first catholyte and the second catholyte are mixed. As an example, the first concentration of a substance to be hydrogenated is 100 mol %, and the second concentration of a substance to be hydrogenated is 5 mol %. The first concentration of a substance to be hydrogenated and the second concentration of a substance to be hydrogenated can be appropriately set based on experiments or simulations.

In the present embodiment, the first storage 44*f* to the third storage 44*h* are constituted by mutually independent tanks. However, the present invention is not limited thereto, and for example, the inside of one tank may be partitioned into a plurality of mutually independent spaces, and each space may constitute the first storage 44*f* to the third storage 44*h*. The number of storages for storing the catholyte as a raw material of the mixed catholyte is not limited to two, that is, the first storage 44*f* and the second storage 44*g*, and may be three or more. For example, the catholyte supply device 8 may include a storage that stores a third catholyte having a third concentration of a substance to be hydrogenated, and the mixed catholyte may be prepared by a combination of the first catholyte to the third catholyte.

The first storage 44*f* to the third storage 44*h* are connected to the cathode chamber 18 by the first cathode pipe 46. One end of the first cathode pipe 46 is branched into a plurality of parts and connected to the first storage 44*f* to the third storage 44*h*, and the other end is connected to the first cathode opening 30. One end of the first cathode pipe 46 of the present embodiment is branched into three of an eleventh branch pipe 46*f* to a thirteenth branch pipe 46*h*. The eleventh branch pipe 46*f* is disposed closest to the first cathode opening 30. The eleventh branch pipe 46*f* is connected to the first storage 44*f*, the twelfth branch pipe 46*g* is connected to the second storage 44*g*, and the thirteenth branch pipe 46*h* is connected to the third storage 44*h*.

The cathode pump 50 is provided in a region on the first cathode opening 30 side of the eleventh branch pipe 46*f* in the middle of the first cathode pipe 46. The seventeenth on-off valve 92 is provided in a region on the first cathode opening 30 side of the cathode pump 50 in the middle of the first cathode pipe 46. The eleventh on-off valve 78 is provided in the middle of the eleventh branch pipe 46*f*. The twelfth on-off valve 80 is provided in the middle of the twelfth branch pipe 46*g*. The thirteenth on-off valve 82 is provided in the middle of the thirteenth branch pipe 46*h*.

The first storage 44*f* to the third storage 44*h* are also connected to the cathode chamber 18 by the second cathode pipe 48. The second cathode pipe 48 has one end connected to the second cathode opening 32 and the other end branched into a plurality of parts and connected to the first storage 44*f* to the third storage 44*h*. In the second cathode pipe 48 of the present embodiment, the other end is branched into three of a fourteenth branch pipe 48*f* to a sixteenth branch pipe 48*h*. The fourteenth branch pipe 48*f* is connected to the first storage 44*f*, the fifteenth branch pipe 48*g* is connected to the second storage 44*g*, and the sixteenth branch pipe 48*h* is connected to the third storage 44*h*. The fourteenth on-off valve 84 is provided in the middle of the fourteenth branch pipe 48*f*. The fifteenth on-off valve 86 is provided in the middle of the fifteenth branch pipe 48*g*. The sixteenth on-off valve 88 is provided in the middle of the sixteenth branch pipe 48*h*.

The first catholyte in the first storage 44*f*, the second catholyte in the second storage 44*g*, and the mixed catholyte in the third storage 44*h* flow into the cathode chamber 18 from the first cathode opening 30 via the first cathode pipe 46 by driving of the cathode pump 50. Which storage 44 supplies the catholyte to the cathode chamber 18 can be switched according to the open/close states of the eleventh on-off valve 78 to the thirteenth on-off valve 82. The catholyte is supplied to the cathode chamber 18 and subjected to an electrode reaction in the cathode electrode 14. The catholyte in the cathode chamber 18 is returned to the first storage 44*f* to the third storage 44*h* via the second cathode pipe 48. Which storage 44 the catholyte is returned to can be switched according to the open/close states of the fourteenth on-off valve 84 to the sixteenth on-off valve 88.

The third storage 44*h* is connected to the cathode pump 50 by the third cathode pipe 76. The eighteenth on-off valve 94 is provided in the middle of the third cathode pipe 76. When the cathode pump 50 is driven when the eleventh on-off valve 78 and the eighteenth on-off valve 94 are in an open state, and the twelfth on-off valve 80, the thirteenth on-off valve 82, and the seventeenth on-off valve 92 are in a closed state, the first catholyte in the first storage 44*f* moves to the third storage 44*h* via the first cathode pipe 46, the cathode pump 50, and the third cathode pipe 76. When the cathode pump 50 is driven when the twelfth on-off valve 80 and the eighteenth on-off valve 94 are in an open state and the eleventh on-off valve 78, the thirteenth on-off valve 82, and the seventeenth on-off valve 92 are in a closed state, the second catholyte in the second storage 44*g* moves to the third storage 44*h* via the first cathode pipe 46, the cathode pump 50, and the third cathode pipe 76.

The organic hydride producing system 1 also includes a concentration sensor 72 that detects the concentrations of substances to be hydrogenated in the first catholyte, the second catholyte, and the mixed catholyte. The concentration sensor 72 repeatedly transmits a signal indicating the detection result to the control device 10. The control device 10 can also calculate the concentration of a substance to be hydrogenated of the catholyte stored in the first storage 44*f* to the third storage 44*h* based on the amount of the catholyte filled in the first storage 44*f* to the third storage 44*h*, the supply amount of the catholyte from the first storage 44*f* to the third storage 44*h* to the cathode chamber 18, and the total power supply amount to the electrolytic bath 2 while the catholyte is supplied.

In the present embodiment, a part of a pipe connecting the first storage 44*f* to the third storage 44*h* and the cathode chamber 18 is shared. However, the present invention is not limited to this configuration, and the pipe connecting the first storage 44*f* to the third storage 44*h* and the cathode chamber 18 may be independent for each storage 44.

The control device 10 controls the supply of power from the power supply 4 to the electrolytic bath 2. The control device 10 controls the anolyte supply device 6 and the catholyte supply device 8. Specifically, the control device 10 controls driving of the anode pump 42 and the cathode pump 50. Further, the control device 10 controls opening and closing of the eleventh on-off valve 78 to the eighteenth on-off valve 94.

The catholyte supply device 8 according to the present embodiment includes the first storage 44*f* to the third storage 44*h*, and can supply any catholyte selected from a plurality of catholytes having different concentrations of substances to be hydrogenated to the cathode chamber 18. Then, the control device 10 controls the catholyte supply device 8 so as to supply the catholyte having a specific concentration of a substance to be hydrogenated to the cathode chamber 18. By selecting the concentration of a substance to be hydrogenated of the catholyte to be supplied to the cathode chamber 18 according to the current density of the electrolytic bath 2, it is possible to increase the production speed of the organic hydride while suppressing the decrease in Faraday efficiency.

The control device 10 of the present embodiment controls the catholyte supply device 8 so as to supply the first catholyte and the second catholyte to the third storage 44*h* to generate a catholyte having a specific concentration of a substance to be hydrogenated. The control device 10 calculates a mixing ratio of the first catholyte and the second catholyte so that the mixed catholyte has a specific concentration of a substance to be hydrogenated. The on-off valves and the cathode pump 50 are controlled so that the calculated amount of the first catholyte is supplied from the first storage 44*f* to the third storage 44*h*. The on-off valves and the cathode pump 50 are controlled so that the calculated amount of the second catholyte is supplied from the second storage 44*g* to the third storage 44*h*.

As a result, a mixed catholyte having a specific concentration of a substance to be hydrogenated is prepared in the third storage 44*h*. Then, the control device 10 controls the catholyte supply device 8 so as to supply the mixed catholyte from the third storage 44*h* to the cathode chamber 18. Further, the control device 10 controls each on-off valve to return the mixed catholyte discharged from the cathode chamber 18 to the third storage 44*h*.

The specific concentration of a substance to be hydrogenated in the present embodiment is determined based on the second example described above. That is, the specific concentration of a substance to be hydrogenated is set by the control device 10. The control device 10 of the present embodiment determines the specific concentration of a substance to be hydrogenated based on the magnitude of the current flowing in the electrolytic bath 2 and the decrease amount of the concentration of a substance to be hydrogenated in the cathode chamber 18. The control device 10 first determines a temporary lower limit value of the concentration of a substance to be hydrogenated in the catholyte to be supplied to the cathode chamber 18 based on the magnitude of the current flowing in the electrolytic bath 2, for example, the magnitude of the current density. Then, the control device 10 determines a true lower limit value by adding the decrease amount of the concentration of a substance to be hydrogenated in the cathode chamber 18 to the temporary lower limit value. The control device 10 determines the specific concentration of a substance to be hydrogenated by adding a predetermined margin to the true lower limit value. The predetermined margin can be appropriately set on the basis of an experiment or a simulation. The lower limit value may be set based only on the magnitude of the current density of the electrolytic bath 2 without considering the decrease amount of the concentration of a substance to be hydrogenated in the cathode chamber 18. The margin may be zero.

The control device 10 basically controls the catholyte supply device 8 so as to supply the mixed catholyte from the third storage 44*h* to the cathode chamber 18. However, when the predetermined condition is satisfied, the catholyte supply device 8 may be controlled such that the catholyte is directly supplied to the cathode chamber 18 from the first storage 44*f* or the second storage 44*g*.

For example, when the concentration obtained by adding a margin to the true lower limit value is equal to or more than the first concentration of a substance to be hydrogenated, the first concentration of a substance to be hydrogenated may be set as the specific concentration of a substance to be hydrogenated. In this case, the control device 10 controls the catholyte supply device 8 so as to supply the first catholyte from the first storage 44*f* to the cathode chamber 18. Similarly, when the concentration obtained by adding a margin to the true lower limit value is equal to or less than the second concentration of a substance to be hydrogenated, the second concentration of a substance to be hydrogenated may be set as the specific concentration of a substance to be hydrogenated. In this case, the control device 10 controls the catholyte supply device 8 so as to supply the second catholyte from the second storage 44*g* to the cathode chamber 18. In addition, for example, when the power supply device 34 is constituted by a solar power generation apparatus and the remaining time until sunset is short, the catholyte supply device 8 may be controlled so as to supply the first catholyte from the first storage 44*f* to the cathode chamber 18 according to the remaining amount of the first catholyte in the first storage 44*f*.

When the concentration of a substance to be hydrogenated of the catholyte in the second storage 44*g* is substantially the same as the target concentration to be finally reached by electrolysis, the supply of the catholyte to the third storage 44*h* may be performed only from the first storage 44*f*. Therefore, for example, when the power supply device 34 is constituted by a solar power generation apparatus and the remaining time until sunset is short, the catholyte may be supplied from the first storage 44*f* to the cathode chamber 18, and the catholyte discharged from the cathode chamber 18 may be returned to the third storage 44*h*. This makes it possible to transfer the catholyte from the first storage 44*f* to the third storage 44*h* while continuing the electrolytic reaction. Preferably, the supply tank is switched from the first storage 44*f* to the third storage 44*h* when the amount of the catholyte and the concentration of a substance to be hydrogenated in the third storage 44*h* satisfy a predetermined requirement. According to such control, the transfer time of the substance to be hydrogenated from the first storage 44*f* to the third storage 44*h* can be effectively utilized.

As described above, the control device 10 can appropriately perform the control of supplying the catholyte in the first storage 44*f* to the cathode chamber 18 and returning the catholyte in the cathode chamber 18 to the third storage 44*h* according to the power supply amount estimated at that time and the concentration and amount of the substance to be hydrogenated of the catholyte stored in each of the first storage 44*f* and the third storage 44*h*.

In addition, even when the concentration of a substance to be hydrogenated in the catholyte in the second storage 44*g* is higher than the target concentration to be reached by electrolysis, for example, when the power supply device 34 is constituted by a solar power generation apparatus and the remaining time until sunset is short, the supply of the catholyte from the second storage 44*g* to the third storage 44*h* is unnecessary. That is, when only the power supply for the remaining short time can be expected, if the concentration of a substance to be hydrogenated in the catholyte in the third storage 44*h* is equal to or more than the lower limit value, the catholyte may be supplied from the third storage 44*h* to the electrolytic bath 2 to perform the electrolysis. If the concentration of a substance to be hydrogenated in the catholyte in the third storage 44*h* is less than the lower limit value, the catholyte may be supplied from the first storage 44*f* to the electrolytic bath 2 to perform electrolysis.

The control device 10 repeats the setting of the specific concentration of a substance to be hydrogenated and the preparation of the mixed catholyte at a predetermined timing. For example, the control device 10 repeats the setting of the specific concentration of a substance to be hydrogenated and the preparation of the mixed catholyte at a predetermined time period. The execution timing of the setting of the specific concentration of a substance to be hydrogenated and the preparation of the mixed catholyte can be appropriately set based on experiments and simulations.

As described above, also with the organic hydride producing system 1 according to the present embodiment, similarly to the organic hydride producing system 1 according to the first embodiment, it is possible to improve the production speed of the organic hydride while suppressing the decrease in Faraday efficiency.

The catholyte supply device 8 of the present embodiment includes at least the first storage 44*f* that stores the first catholyte having the first concentration of a substance to be hydrogenated, the second storage 44*g* that stores the second catholyte having the second concentration of a substance to be hydrogenated lower than the first concentration of a substance to be hydrogenated, and the third storage to which the first catholyte is supplied from the first storage and the second catholyte is supplied from the second storage. Then, the control device 10 controls the catholyte supply device 8 so as to supply at least the first catholyte and, if necessary, the second catholyte to the third storage 44*h* to generate a catholyte having a specific concentration of a substance to be hydrogenated, and to supply the catholyte from the third storage 44*h* to the cathode chamber 18.

With such a configuration, it is possible to supply the catholyte having a specific concentration of a substance to be hydrogenated to the cathode chamber 18 while maintaining the concentrations of substances to be hydrogenated of the first catholyte and the second catholyte. Therefore, it is possible to avoid the situation described in the first embodiment in which electrolysis must be performed by reducing the current density while supplying the catholyte having less than a specific concentration of a substance to be hydrogenated to the cathode chamber 18. Therefore, the production speed of the organic hydride can be further improved. In addition, since the number of storages 44 can be reduced as compared with the organic hydride producing system 1 according to the first embodiment, equipment cost and installation space can be reduced.

Figure 7:
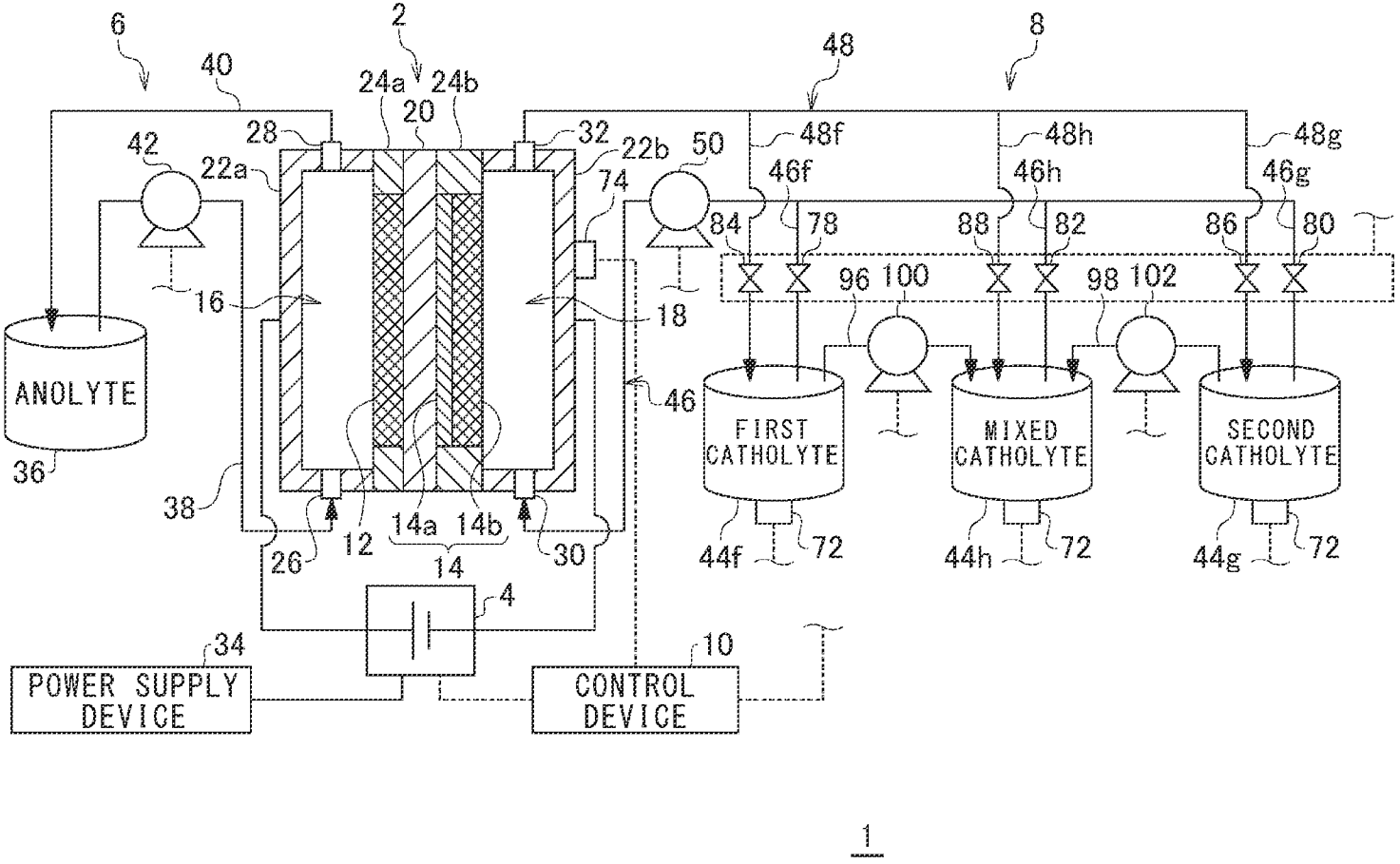
FIG. 7 is a schematic diagram of an organic hydride producing system according to a first modification.

On the other hand, in the organic hydride producing system 1 according to the present embodiment, it takes time to prepare the mixed catholyte. Therefore, the organic hydride producing system 1 according to the first embodiment can more quickly respond to the fluctuation in the power supply amount from the power supply device 34 than the organic hydride producing system 1 according to the present embodiment. The organic hydride producing system 1 according to the second embodiment can include the following first modification. FIG. 7 is a schematic diagram of an organic hydride producing system 1 according to the first modification. The catholyte supply device 8 according to the present modification includes, instead of the third cathode pipe 76, a fourth cathode pipe 96 connecting the first storage 44*f* and the third storage 44*h*, and a fifth cathode pipe 98 connecting the second storage 44*g* and the third storage 44*h*. A first mixing pump 100 is provided in the middle of the fourth cathode pipe 96. A second mixing pump 102 is provided in the middle of the fifth cathode pipe 98. The first mixing pump 100 and the second mixing pump 102 are controlled by the control device 10.

When the first mixing pump 100 is driven, the first catholyte in the first storage 44*f* can be moved to the third storage 44*h* via the fourth cathode pipe 96. By driving the second mixing pump 102, the second catholyte in the second storage 44*g* can be moved to the third storage 44*h* via the fifth cathode pipe 98. As a result, a mixed catholyte having a specific concentration of a substance to be hydrogenated is prepared in the third storage 44*h*.

According to the present modification, the first catholyte and the second catholyte can be directly supplied to the third storage 44*h* without detouring to the cathode pump 50 side. Therefore, the time required for preparing the mixed catholyte can be shortened. Therefore, as compared with the organic hydride producing system 1 according to the second embodiment, it is possible to enhance the followability with respect to the fluctuation in the power supply amount from the power supply device 34.

The embodiments of the present invention have been described in detail above. The above-described embodiments are merely specific examples for carrying out the present invention. The contents of the embodiments do not limit the technical scope of the present invention, and many design changes such as changes, additions, and deletions of components can be made without departing from the spirit of the invention defined in the claims. A new embodiment to which the design change is made has the combined effect of each of the embodiment and the modification. In the above-described embodiment, the contents that can be subjected to such design changes are emphasized with notations such as "of the present embodiment" and "in the present embodiment", but the design changes are allowed even in the contents without such notations. Any combination of the above-described components is also effective as an aspect of the present invention.

The embodiments may also be specified as the items described below.

Item 1

An organic hydride producing system (1) including:

an electrolytic bath (2) having a cathode chamber (18) for accommodating a cathode electrode (14) for hydrogenating a substance to be hydrogenated in a catholyte with a proton to generate an organic hydride;

a catholyte supply device (8) capable of supplying any catholyte selected from a plurality of the catholytes having different concentrations of substances to be hydrogenated to the cathode chamber (18); and a control device (10) that controls the catholyte supply device (8) so as to supply a catholyte to the cathode chamber (18), the catholyte having a specific concentration of a substance to be hydrogenated determined according to a magnitude of a current flowing in the electrolytic bath (2).

Item 2

A control device (10) of an organic hydride producing system (1) including an electrolytic bath (2) and a catholyte supply device (8), in which the electrolytic bath (2) has a cathode chamber (18) for accommodating a cathode electrode (14) for hydrogenating a substance to be hydrogenated in a catholyte with a proton to generate an organic hydride, in which the catholyte supply device (8) is capable of supplying any catholyte selected from a plurality of the catholytes having different concentrations of substances to be hydrogenated to the cathode chamber (18), and in which the control device (10) controls the catholyte supply device (8) so as to supply the catholyte to the cathode chamber (18), the catholyte having a specific concentration of a substance to be hydrogenated determined according to a magnitude of a current flowing in the electrolytic bath (2).

Item 3

A method for controlling an organic hydride producing system (1) including an electrolytic bath (2) having a cathode chamber (18) for accommodating a cathode electrode (14) for hydrogenating a substance to be hydrogenated in a catholyte with a proton to generate an organic hydride, the method including:

supplying the catholyte to the cathode chamber (18), the catholyte having a specific concentration of a substance to be hydrogenated determined according to a magnitude of a current flowing in the electrolytic bath (2).

The invention claimed is:

1. An organic hydride producing system comprising:

an electrolytic bath having a cathode chamber for accommodating a cathode electrode for hydrogenating a substance to be hydrogenated in a catholyte with a proton to generate an organic hydride;

a catholyte supply device capable of supplying any catholyte selected from a plurality of the catholytes having different concentrations of substances to be hydrogenated to the cathode chamber; and a control device structured to determine a specific concentration of a substance to be hydrogenated according to a magnitude of a current flowing in the electrolytic bath and control the catholyte supply device so as to supply a catholyte to the cathode chamber, the catholyte having the specific concentration of the substance to be hydrogenated.

2. The organic hydride producing system according to claim 1, wherein the catholyte supply device includes a plurality of storages that individually store the plurality of catholytes, and wherein the control device determines a lower limit value of a concentration of a substance to be hydrogenated in a catholyte to be supplied to the cathode chamber based on the magnitude of the current, selects a storage that stores a catholyte having a specific concentration of a substance to be hydrogenated from among the storages that store a catholyte having a concentration of a substance to be hydrogenated equal to or more than the lower limit value, and controls the catholyte supply device so as to supply the catholyte from the selected storage to the cathode chamber.

3. The organic hydride producing system according to claim 2, wherein the control device determines the lower limit value based on a decrease amount of the concentration of a substance to be hydrogenated in the cathode chamber in addition to the magnitude of the current.

4. The organic hydride producing system according to claim 2, wherein the control device selects the storage that stores the catholyte having a concentration of a substance to be hydrogenated equal to or more than the lower limit value and closest to the lower limit value as the storage that stores the catholyte having the specific concentration of a substance to be hydrogenated.

5. The organic hydride producing system according to claim 1, wherein the catholyte supply device at least includes:

a first storage structured to store a first catholyte having a first concentration of a substance to be hydrogenated;

a second storage structured to store a second catholyte having a second concentration of a substance to be hydrogenated lower than the first concentration of a substance to be hydrogenated; and a third storage capable of receiving supply of the first catholyte from the first storage and supply of the second catholyte from the second storage, and wherein the control device controls the catholyte supply device so as to supply the first catholyte and the second catholyte to the third storage to generate the catholyte having the specific concentration of a substance to be hydrogenated, and to supply the catholyte from the third storage to the cathode chamber.

6. The organic hydride producing system according to claim 5, wherein the control device determines the specific concentration of a substance to be hydrogenated based on a decrease amount of the concentration of a substance to be hydrogenated in the cathode chamber in addition to the magnitude of the current.

* * * * *